US011449000B2

(12) United States Patent
Unno et al.

(10) Patent No.: US 11,449,000 B2
(45) Date of Patent: Sep. 20, 2022

(54) ELECTROPHOTOGRAPHIC APPARATUS, PROCESS CARTRIDGE, AND CARTRIDGE SET

(71) Applicant: CANON KABUSHIKI KAISHA, Tokyo (JP)

(72) Inventors: Tomohiro Unno, Shizuoka (JP); Kosuke Fukudome, Tokyo (JP); Dai Nozaki, Shizuoka (JP); Kozue Uratani, Shizuoka (JP); Yuta Komiya, Shizuoka (JP); Kazuhiro Yamauchi, Shizuoka (JP); Masahiro Kurachi, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 43 days.

(21) Appl. No.: 17/071,246

(22) Filed: Oct. 15, 2020

(65) Prior Publication Data

US 2021/0116859 A1 Apr. 22, 2021

(30) Foreign Application Priority Data

Oct. 18, 2019 (JP) ..... JP2019-191593

(51) Int. Cl.
*G03G 21/18* (2006.01)
*G03G 9/087* (2006.01)
(Continued)

(52) U.S. Cl.
CPC ..... *G03G 21/1814* (2013.01); *G03G 9/08755* (2013.01); *G03G 9/08782* (2013.01);
(Continued)

(58) Field of Classification Search
CPC ..... G03G 21/1814; G03G 9/08755; G03G 9/08782; G03G 9/08797; G03G 15/0233; G03G 5/0553
See application file for complete search history.

(56) References Cited

U.S. PATENT DOCUMENTS 6,697,587 B2 2/2004 Harada
6,864,030 B2 3/2005 Shirai et al.
(Continued)

FOREIGN PATENT DOCUMENTS

JP 2002003651 A 1/2002
JP 2003107781 A 4/2003
(Continued)

OTHER PUBLICATIONS

U.S. Appl. No. 17/065,258, Kohei Makisumi, filed Oct. 7, 2020.
(Continued)

*Primary Examiner* — Ryan D Walsh
(74) *Attorney, Agent, or Firm* — Venable LLP

(57) ABSTRACT

An electrophotographic apparatus having an electrophotographic photosensitive member, a charging unit, and a developing unit for forming a toner image, wherein the charging unit has a conductive member disposed to be contactable with the electrophotographic photosensitive member, a conductive layer at the surface of the conductive member has a matrix-domain structure, at least a portion of the domains is exposed at the outer surface of the conductive member, the outer surface of the conductive member is constituted at least of the matrix and these domains, a volume resistivity R1 of the matrix is greater than $1.00\times10^{12}$ Ω·cm, a volume resistivity R2 of the domains is less than R1, Martens hardness G1 of the matrix and Martens hardness G2 of the domains satisfy a prescribed relationship, and an onset temperature T(A) for a storage elastic modulus E' of the toner is not more than 80.0° C.

11 Claims, 7 Drawing Sheets

(51) Int. Cl.
*G03G 15/02* (2006.01)
*G03G 5/05* (2006.01)

(52) U.S. Cl.
CPC ..... *G03G 9/08797* (2013.01); *G03G 15/0233* (2013.01); *G03G 5/0553* (2013.01)

(56) References Cited

U.S. PATENT DOCUMENTS

| | | | | |
|---|---|---|---|---|
| 7,799,398 | B2 | 9/2010 | Nakamura et al. | |
| 8,298,670 | B2 | 10/2012 | Muranaka et al. | |
| 8,449,975 | B2 | 5/2013 | Hirakoso et al. | |
| 8,503,916 | B2 | 8/2013 | Anan et al. | |
| 8,628,854 | B2 | 1/2014 | Yamauchi et al. | |
| 8,660,472 | B2 | 2/2014 | Kurachi et al. | |
| 8,668,987 | B2 | 3/2014 | Yamauchi et al. | |
| 8,715,830 | B2 | 5/2014 | Yamada et al. | |
| 8,771,818 | B2 | 7/2014 | Nishioka et al. | |
| 8,852,743 | B2 | 10/2014 | Kikuchi et al. | |
| 9,023,465 | B2 | 5/2015 | Yamada et al. | |
| 9,086,643 | B2 | 7/2015 | Kikuchi et al. | |
| 9,128,403 | B2 | 9/2015 | Yamauchi et al. | |
| 9,146,482 | B2 | 9/2015 | Watanabe et al. | |
| 9,360,789 | B1 | 6/2016 | Masu et al. | |
| 9,442,408 | B2 | 9/2016 | Yamauchi et al. | |
| 9,442,451 | B2 | 9/2016 | Yamauchi et al. | |
| 9,541,854 | B2 | 1/2017 | Kikuchi et al. | |
| 9,547,250 | B2 | 1/2017 | Kikuchi et al. | |
| 9,551,947 | B2 | 1/2017 | Hiroko et al. | |
| 9,551,949 | B2 | 1/2017 | Yamauchi et al. | |
| 9,556,359 | B2 | 1/2017 | Suzumura et al. | |
| 9,581,931 | B2 | 2/2017 | Yamada et al. | |
| 9,599,913 | B2 | 3/2017 | Nishioka et al. | |
| 9,639,009 | B2 | 5/2017 | Yamaguchi et al. | |
| 9,651,888 | B2 | 5/2017 | Muranaka et al. | |
| 9,665,028 | B2 | 5/2017 | Arimura et al. | |
| 9,665,029 | B2 | 5/2017 | Hino et al. | |
| 9,740,133 | B2 | 8/2017 | Yamauchi et al. | |
| 9,811,009 | B2 | 11/2017 | Yamada et al. | |
| 9,811,021 | B2 | 11/2017 | Muranaka et al. | |
| 9,897,931 | B2 | 2/2018 | Nishioka et al. | |
| 9,958,802 | B2 | 5/2018 | Kikuchi et al. | |
| 9,964,874 | B2 | 5/2018 | Suzumura et al. | |
| 9,964,881 | B2 | 5/2018 | Ikejiri et al. | |
| 9,964,914 | B2 | 5/2018 | Arimura et al. | |
| 9,977,353 | B2 | 5/2018 | Nishioka et al. | |
| 10,018,927 | B2 | 7/2018 | Yamada et al. | |
| 10,018,934 | B2 | 7/2018 | Yamada et al. | |
| 10,108,129 | B2 | 10/2018 | Yamaguchi et al. | |
| 10,280,148 | B2 | 5/2019 | Nishioka et al. | |
| 10,416,588 | B2 | 9/2019 | Masu et al. | |
| 10,488,777 | B2 | 11/2019 | Terauchi et al. | |
| 10,649,350 | B2 | 5/2020 | Yamaguchi et al. | |
| 10,678,154 | B2 | 6/2020 | Takashima et al. | |
| 10,678,158 | B2 | 6/2020 | Kikuchi et al. | |
| 11,061,342 | B2 * | 7/2021 | Umeda | G03G 5/0553 |
| 11,112,719 | B2 * | 9/2021 | Makisumi | G03G 21/1814 |
| 11,137,716 | B2 * | 10/2021 | Hiyama | G03G 5/00 |
| 2012/0251171 | A1 | 10/2012 | Muranaka et al. | |
| 2012/0308261 | A1 | 12/2012 | Tsuru et al. | |
| 2013/0281276 | A1 | 10/2013 | Watanabe et al. | |
| 2014/0072343 | A1 | 3/2014 | Masu et al. | |
| 2014/0080691 | A1 | 3/2014 | Kurachi et al. | |
| 2014/0255838 | A1 * | 9/2014 | Matsuda | G03G 5/14708 430/56 |
| 2015/0331346 | A1 | 11/2015 | Yamauchi et al. | |
| 2017/0336727 | A1 * | 11/2017 | Ikejiri | G03G 9/0904 |
| 2020/0150552 | A1 * | 5/2020 | Shindo | G03G 15/1685 |
| 2020/0225593 | A1 | 7/2020 | Yamaguchi et al. | |
| 2020/0310264 | A1 | 10/2020 | Kurachi et al. | |
| 2020/0310265 | A1 | 10/2020 | Nishioka et al. | |
| 2020/0310266 | A1 | 10/2020 | Kikuchi et al. | |
| 2020/0392306 | A1 * | 12/2020 | Lee | C09D 7/61 |
| 2021/0026295 | A1 | 1/2021 | Yamada et al. | |
| 2021/0033996 | A1 | 2/2021 | Kikuchi et al. | |
| 2021/0041796 | A1 | 2/2021 | Nishioka et al. | |
| 2021/0116826 | A1 * | 4/2021 | Nishida | G03G 21/1814 |
| 2021/0116827 | A1 * | 4/2021 | Fukudome | G03G 9/0823 |
| 2021/0116829 | A1 * | 4/2021 | Tomono | C08K 3/04 |
| 2021/0116831 | A1 * | 4/2021 | Tominaga | G03G 9/09716 |
| 2021/0116832 | A1 * | 4/2021 | Kototani | G03G 9/08711 |
| 2021/0116833 | A1 * | 4/2021 | Ishiduka | G03G 15/0233 |
| 2021/0116856 | A1 * | 4/2021 | Mukai | G03G 9/0825 |
| 2021/0116858 | A1 * | 4/2021 | Watariguchi | G03G 5/0553 |
| 2021/0116859 | A1 * | 4/2021 | Unno | G03G 15/0233 |
| 2021/0116860 | A1 * | 4/2021 | Suzumura | C08K 3/26 |

FOREIGN PATENT DOCUMENTS

| | | | |
|---|---|---|---|
| JP | 2003280246 | A | 10/2003 |
| JP | 2005049630 | A | 2/2005 |
| JP | 2012068623 | A | 4/2012 |
| JP | 2017107169 | A | 6/2017 |
| JP | 2017207680 | A | 11/2017 |
| JP | 2017211648 | A | 11/2017 |
| JP | 2018077385 | A | 5/2018 |
| JP | 2019045578 | A | 3/2019 |

OTHER PUBLICATIONS

U.S. Appl. No. 17/069,919, Tsutomu Nishida, filed Oct. 14, 2020.
U.S. Appl. No. 17/070,054, Yuka Ishiduka, filed Oct. 14, 2020.
U.S. Appl. No. 17/070,085, Fumiyuki Hiyama, filed Oct. 14, 2020.
U.S. Appl. No. 17/070,179, Kaname Watariguchi, filed Oct. 14, 2020.
U.S. Appl. No. 17/071,103, Noriyoshi Umeda, filed Oct. 15, 2020.
U.S. Appl. No. 17/071,109, Shohei Kototani, filed Oct. 15, 2020.
U.S. Appl. No. 17/071,227, Kosuke Fukudome, filed Oct. 15, 2020.
U.S. Appl. No. 17/071,283, Yoshitaka Suzumura, filed Oct. 15, 2020.
U.S. Appl. No. 17/071,535, Hiroyuki Tomono, filed Oct. 15, 2020.
U.S. Appl. No. 17/071,540, Tsuneyoshi Tominaga, filed Oct. 15, 2020.

* cited by examiner

ELECTROPHOTOGRAPHIC APPARATUS, PROCESS CARTRIDGE, AND CARTRIDGE SET

BACKGROUND OF THE INVENTION

Field of the Invention

The present disclosure is directed to an electrophotographic apparatus, a process cartridge, and a cartridge set.

Description of the Related Art

In recent years, electrophotographic apparatuses such as copiers, printers, and so forth are required to realize greater energy savings. As a consequence, the development of a toner capable of being fixed at lower temperatures has also been going forward within the toner realm.

Japanese Patent Application Laid-open No. 2017-211648 discloses a toner that exhibits an enhanced low-temperature plasticity brought about by the use of crystalline polyester. Japanese Patent Application Laid-open No. 2017-211648 states that so-called cold offset—in which, due to an insufficient melting of a toner, the toner attaches onto a fixing film during passage through a fixing nip and, after a single rotation in this condition, fixing onto the paper is implemented—can be suppressed. Japanese Patent Application Laid-open No. 2017-211648 also states that a sharp melt property can be enhanced by dispersing such a crystalline material in the form of microfine domains in the toner.

In Japanese Patent Application Laid-open No. 2017-207680, through the combination of domain control of a crystalline polyester and a low-melting wax, both the low-temperature fixability brought about by a sharp melt property and the storability at high temperatures can be implemented.

SUMMARY OF THE INVENTION

When image formation is carried out at a high process speed, the frequency with which untransferred toner slips past a cleaning blade increases and then an amount of untransferred toner coming into contact with a charging member tends to increase.

On the other hand, the toners according to Japanese Patent Application Laid-open Nos. 2017-211648 and 2017-207680, which exhibit excellent low-temperature fixabilities, readily undergo deformation, for example, when used in a high-temperature, high-humidity environment.

As a consequence, when, in a high-temperature, high-humidity environment, these toners, which exhibit excellent low-temperature fixabilities, become attached, as untransferred toner, to the surface of the charging member, this untransferred toner melt-adheres to the surface of the charging member and may form a film of fused toner material on the surface of the charging member. It has been found that a charging member having on an outer surface thereof such a fused material film cannot uniformly charge the electrophotographic photosensitive member and may cause non-uniformity in an image.

For example, one method for suppressing toner deformation, as in Japanese Patent Application Laid-open No. 2003-280246, is to improve the viscoelasticity of the toner using, for example, a crosslinking agent. However, the fixation temperature of such a toner becomes relatively high. That is, the inhibition of toner deformation resides in a trade-off relationship with an excellent low-temperature fixability.

The present disclosure provides an electrophotographic apparatus, a process cartridge, and a cartridge set that exhibit an excellent energy-savings performance and are able to form a high-quality electrophotographic image in a stable manner.

One aspect of the present disclosure provides an electrophotographic apparatus comprising:

an electrophotographic photosensitive member, a charging unit for charging a surface of the electrophotographic photosensitive member, and a developing unit for developing an electrostatic latent image formed on the surface of the electrophotographic photosensitive member with a toner to form a toner image on the surface of the electrophotographic photosensitive member electrophotographic photosensitive member, wherein the charging unit comprises a conductive member disposed to be contactable with the electrophotographic photosensitive member, the conductive member comprises:

a support having a conductive outer surface, and a conductive layer disposed on the outer surface of the support, the conductive layer comprises:

a matrix, and a plurality of domains dispersed in the matrix, the matrix contains a first rubber, each of the domains contains a second rubber and an electronic conductive agent, at least a portion of the domains is exposed at the outer surface of the conductive member, the outer surface of the conductive member is constituted of at least the matrix and the domains that are exposed at the outer surface of the conductive member, the matrix has a volume resistivity R1 of greater than $1.00\times10^{12}$ Ω·cm, a volume resistivity R2 of the domains is smaller than the volume resistivity R1 of the matrix, when G1 is Martens hardness measured on the matrix that is exposed at the outer surface of the conductive member, and G2 is Martens hardness measured on the domains that are exposed at the outer surface of the conductive member, G1 and G2 are both within a range from 1.0 $N/mm^2$ to 10.0 $N/mm^2$, and satisfy relationship $G1<G2$, the developing unit contains the toner, the toner has a toner particle that contains a binder resin, a colorant, and a crystalline material, and the toner has an onset temperature T(A) of not more than 80.0° C., T(A) being an onset temperature of the storage elastic modulus E' according to powder dynamic viscoelastic measurement.

Another aspect of the present disclosure provides a process cartridge disposed detachably to a main body of an electrophotographic apparatus, wherein the process cartridge comprises a charging unit for charging a surface of an electrophotographic photosensitive member, and a developing unit for developing an electrostatic latent image formed on the surface of the electrophotographic photosensitive member with a toner to form a toner image on the surface of the electrophotographic photosensitive member, the charging unit comprises a conductive member disposed to be contactable with the electrophotographic photosensitive member, the conductive member comprises:

a support having a conductive outer surface, and a conductive layer disposed on the outer surface of the support, the conductive layer comprises:

a matrix, and a plurality of domains dispersed in the matrix, the matrix contains a first rubber, each of the domains contains a second rubber and an electronic conductive agent, at least a portion of the domains is exposed at the outer surface of the conductive member, the outer surface of the conductive member is constituted of at least the matrix and the domains that are exposed at the outer surface of the conductive member, the matrix has a volume resistivity R1 of greater than $1.00\times10^{12}$ Ω·cm, a volume resistivity R2 of the domains is smaller than the volume resistivity R1 of the matrix, when G1 is Martens hardness measured on the matrix that is exposed at the outer surface of the conductive member and G2 is Martens hardness measured on the domains that are exposed at the outer surface of the conductive member, G1 and G2 are both within a range from 1.0 $N/mm^2$ to 10.0 $N/mm^2$ and satisfy relationship G1<G2, the developing unit contains the toner, the toner has a toner particle that contains a binder resin, a colorant, and a crystalline material, and the toner has an onset temperature T(A) of not more than 80.0° C., T(A) being an onset temperature of a storage elastic modulus E' according to powder dynamic viscoelastic measurement.

Another aspect of the present disclosure provides a cartridge set having a first cartridge and a second cartridge that are disposed detachably to a main body of an electrophotographic apparatus, wherein the first cartridge has a charging unit for charging a surface of an electrophotographic photosensitive member and has a first frame for supporting the charging unit, the second cartridge has a toner container that accommodates a toner for forming a toner image on the surface of the electrophotographic photosensitive member by developing an electrostatic latent image formed on the surface of the electrophotographic photosensitive member, the charging unit comprises a conductive member disposed to be contactable with the electrophotographic photosensitive member, the conductive member comprises:

a support having a conductive outer surface, and a conductive layer disposed on the outer surface of the support, the conductive layer comprises:

a matrix, and a plurality of domains dispersed in the matrix, the matrix contains a first rubber, each of the domains contains a second rubber and an electronic conductive agent, at least a portion of the domains are exposed at the outer surface of the conductive member, the outer surface of the conductive member is constituted of at least the matrix and the domains that are exposed at the outer surface of the conductive member, the matrix has a volume resistivity R1 of greater than $1.00\times10^{12}$ Ω·cm, a volume resistivity R2 of the domains is smaller than the volume resistivity R1 of the matrix, when G1 is Martens hardness measured on the matrix that is exposed at the outer surface of the conductive member and G2 is Martens hardness measured on the domains that are exposed at the outer surface of the conductive member, G1 and G2 are both within a range from 1.0 $N/mm^2$ to 10.0 $N/mm^2$ and satisfy relationship G1<G2, the toner has a toner particle that contains a binder resin, a colorant, and a crystalline material, and the toner has an onset temperature T(A) of not more than 80.0° C., T(A) being an onset temperature of a storage elastic modulus E' according to powder dynamic viscoelastic measurement.

The present disclosure can provide an electrophotographic apparatus, a process cartridge, and a cartridge set that exhibit an excellent energy-savings performance and are able to form a high-quality electrophotographic image in a stable manner.

Further features of the present invention will become apparent from the following description of exemplary embodiments with reference to the attached drawings.

DESCRIPTION OF THE EMBODIMENTS

Figure 1:
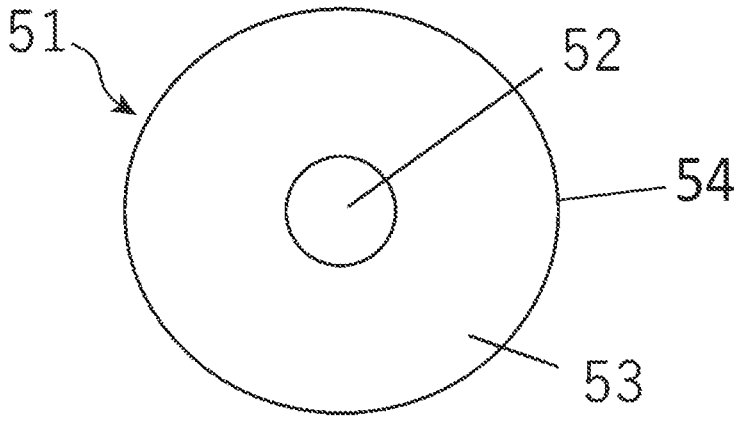
FIG. 1 is a cross-sectional diagram of a charging roller for the direction orthogonal to the longitudinal direction.

Unless specifically indicated otherwise, the expressions "from XX to YY" and "XX to YY" that show numerical value ranges refer to numerical value ranges that include the lower limit and upper limit that are the end points.

When numerical value ranges are provided in stages, the upper limits and lower limits of the individual numerical value ranges may be combined in any combination.

As a result of investigations by the present inventors, it was discovered that, through the combination of the toner described herebelow with the conductive member described herebelow, the stable formation of a high-quality electrophotographic image can be made to coexist with a substantial boost in the energy-savings performance during electrophotographic image formation.

Toner

The toner has a toner particle that contains a binder resin, colorant, and crystalline material, and has an onset temperature T(A) for the storage elastic modulus E' according to powder dynamic viscoelastic measurement of not more than 80.0° C.

Conductive Member

The conductive member has a support having a conductive outer surface and has a conductive layer disposed on this outer surface of the support, the conductive layer has a matrix and a plurality of domains dispersed in this matrix, with the matrix containing a first rubber and the domains containing a second rubber and an electronic conductive agent, at least a portion of the domains is exposed at the outer surface of the conductive member, the outer surface of the conductive member is constituted of at least the matrix and the domains that are exposed at the outer surface of the conductive member, the matrix has a volume resistivity R1 of greater than $1.00\times10^{12}$ Ω·cm, a volume resistivity R2 of the domains is smaller than the volume resistivity R1 of the matrix, and when G1 is Martens hardness measured on the matrix that is exposed at the outer surface of the conductive member and G2 is Martens hardness measured on the domains that are exposed at the outer surface of the conductive member, G1 and G2 are both within a range from 1.0 N/mm$^2$ to 10.0 N/mm$^2$ and satisfy relationship G1<G2.

The outer surface of the conductive member is the surface in contact with the toner at the conductive member.

The toner is a toner that readily softens at low temperatures (80° C.) and exhibits an excellent low-temperature fixability.

The conductive member, on the other hand, when used as the charging member can continuously apply a stable amount of electrical discharge to the object being charged, such as the electrophotographic photosensitive member or untransferred toner. As a consequence, it is thought that when untransferred toner has come into contact with the surface of the conductive member, a stable electrical discharge to the untransferred toner can be generated and this untransferred toner can then be uniformly negatively charged. It is thought that electrostatic attachment of the untransferred toner to the surface of the conductive member can be inhibited as a result.

The present inventors hypothesize the following as to the reasons for the ability of a conductive member provided with the above-described structure to continuously apply a stable amount of electrical discharge to the object to be charged.

When a charging bias is applied between the support in the conductive member and the electrophotographic photosensitive member, it is thought that within the conductive layer the charge migrates, proceeding as described in the following, to the side of the conductive layer opposite from the support side, i.e., to the outer surface side of the conductive member. That is, the charge accumulates in the neighborhood of the matrix/domain interface.

In addition, this charge successively transfers from the domains located on the side of the conductive support to the domains on the side opposite from the side of the conductive support, to reach the conductive layer surface (also referred to hereafter as the "outer surface of the conductive layer") on the side opposite from the side of the conductive support. When this occurs, and when, in a first charging process, the charge on all the domains has transferred to the outer surface side of the conductive layer, time is required for charge to accumulate in the conductive layer for the next charging process. It is thus difficult for a stable electrical discharge to be achieved in a high-speed electrophotographic image-forming process.

Accordingly, even when a charging bias has been applied, preferably charge transfer between domains does not occur simultaneously. In addition, since, in a high-speed electrophotographic image-forming process, charge movement is limited, preferably a satisfactory amount of charge is accumulated at each domain to bring about the discharge of a satisfactory amount of charge in a single electrical discharge.

The conductive layer includes a matrix and a plurality of domains dispersed in the matrix. In addition, the matrix contains a first rubber and each of the domains contains a second rubber and an electronic conducting agent. The matrix and the domains satisfy the following component factor (i) and component factor (ii).

component factor (i): The volume resistivity R1 of the matrix is greater than $1.00\times10^{12}$ Ω·cm.

component factor (ii): The volume resistivity R2 of the domains is smaller than the volume resistivity R1 of the matrix.

A conductive member provided with a conductive layer that satisfies component factors (i) and (ii) can accumulate satisfactory charge at the individual domains when a bias is applied with the photosensitive member. In addition, since the domains are divided from each other by the electrically insulating matrix, simultaneous charge transfer between domains can be inhibited. As a consequence of this, the discharge in a single electrical discharge of the majority of the charge accumulated within the conductive layer can be prevented.

As a result, a state can be set up within the conductive layer in which, even directly after the completion of a first electrical discharge, charge for the next electrical discharge is still accumulated. Due to this, a stable electrical discharge can be produced on a short cycle. Such an electrical discharge achieved by the conductive member according to the present disclosure is also referred to as a "microdischarge" in the following.

As described in the preceding, the conductive layer provided with a matrix-domain structure that satisfies component factors (i) and (ii) can suppress the occurrence of simultaneous charge transfer between domains when a bias is applied and can bring about the accumulation of satisfactory charge within the domains. As a consequence, this conductive member, even when deployed in an electrophotographic image-forming apparatus having a fast process speed, can continuously impart a stable charge to an article to be charged.

In addition, the Martens hardnesses G1 and G2, which are respectively measured on the matrix and domains exposed at the outer surface of the conductive member, are both in the range from 1.0 N/mm$^2$ to 10.0 N/mm$^2$. A Martens hardness in the indicated range indicates a relative flexibility, and due to this it is difficult to cause deformation of the aforementioned toner, which has an excellent low-temperature fixability.

Moreover, it is thought that because the outer surface of the conductive member is constituted of two regions (matrix and domains) that have different Martens hardnesses, rolling of the untransferred toner in contact with the outer surface is facilitated. It is thought that as a result, the untransferred toner can be more uniformly negative charged and the electrostatic attachment of the untransferred toner to the outer surface can be even more effectively suppressed.

Conductive Member

A conductive member having a roller configuration (also referred to hereinbelow as a "conductive roller") will be described with reference to FIG. 1 as an example of the conductive member. FIG. 1 is a diagram of a cross section orthogonal to the direction along the axis of the conductive roller (also referred to hereinbelow as the "longitudinal direction"). The conductive roller 51 has a cylindrical conductive support 52 and has a conductive layer 53 formed on the circumference of the support 52, i.e., on the outer surface 54 of the support.

The Support

The material constituting the support can be a suitable selection from materials known in the field of conductive members for electrophotographic applications and materials that can be utilized as a conductive member. Examples here are metals and alloys such as aluminum, stainless steel, conductive synthetic resins, iron, copper alloys, and so forth.

An oxidation treatment or a plating treatment, e.g., with chromium, nickel, and so forth, may be executed on the preceding. Electroplating or electroless plating may be used as the plating mode. Electroless plating is preferred from the standpoint of dimensional stability. The type of electroless plating used here can be exemplified by nickel plating, copper plating, gold plating, and plating with various alloys.

The plating thickness is preferably at least 0.05 μm, and a plating thickness from 0.10 μm to 30.00 μm is preferred based on a consideration of the balance between production efficiency and anti-corrosion performance. The cylindrical shape of the support may be a solid cylindrical shape or a hollow cylindrical shape (tubular shape). The outer diameter of the support is preferably in the range from 3 mm to 10 mm.

When a medium-resistance layer or insulating layer is present between the support and the conductive layer, it may then not be possible to rapidly supply charge after charge has been consumed by electrical discharge. Thus, preferably either the conductive layer is directly disposed on the support or the conductive layer is disposed on the outer periphery of the support with only an interposed intermediate layer including a conductive thin-film resin layer, e.g., a primer.

A selection from known primers, in conformity with, e.g., the material of the support and the rubber material used to form the conductive layer, can be used as this primer. The material of the primer can be exemplified by thermosetting resins and thermoplastic resins, and known materials such as phenolic resins, urethane resins, acrylic resins, polyester resins, polyether resins, and epoxy resins can specifically be used.

The Conductive Layer

The conductive layer includes a matrix and a plurality of domains dispersed in the matrix. In addition, the matrix contains a first rubber and the domains contain a second rubber and an electronic conducting agent. The matrix and the domains satisfy the following component factors (i) and (ii).

component factor (i): The volume resistivity R1 of the matrix is greater than $1.00\times10^{12}$ Ω·cm.

component factor (ii): The volume resistivity R2 of the domains is smaller than the volume resistivity R1 of the matrix.

Component Factor (i): Matrix Volume Resistivity

By having the volume resistivity R1 of the matrix be greater than $1.00\times10^{12}$ Ω·cm, the movement of charge in the matrix while circumventing the domains can be suppressed. In addition, consumption of the majority of accumulated charge by a single electrical discharge can be suppressed. Moreover, this can prevent the charge accumulated in the domains, through its leakage into the matrix, from providing a condition as if conduction pathways that communicate within the conduction layer were to be formed.

The volume resistivity R1 is preferably at least $2.00\times10^{12}$ Ω·cm. The upper limit on R1, on the other hand, is not particularly limited, but as a guide not more than $1.00\times10^{17}$ Ω·cm is preferred and not more than $8.00\times10^{16}$ Ω·cm is more preferred.

The present inventors believe that a structure in which regions where charge is satisfactorily accumulated (domains) are partitioned off by an electrically insulating region (matrix), is effective for bringing about charge transfer via the domains in the conductive layer and achieving microdischarge. In addition, by having the matrix volume resistivity be in the range of a high-resistance region as indicated above, adequate charge can be kept at the interface with each domain and charge leakage from the domains can also be suppressed.

In addition, in order for the electrical discharge to achieve a level of electrical discharge that is necessary and sufficient and a microdischarge, it is very effective to limit the charge transfer pathways to domain-mediated pathways. By suppressing charge leakage from the domains into the matrix and limiting the charge transport pathways to pathways that proceed via a plurality of domains, the density of the charge present on the domains can be boosted and due to this the amount of charge loaded at each domain can be further increased.

It is thought that this supports an increase, at the surface of the domains in their role as a conductive phase that is the source of the electrical discharge, in the overall charge population able to participate in electrical discharge, and that as a result the ease of electrical discharge elaboration from the surface of the conductive member can be enhanced.

Method for Measuring the Volume Resistivity of the Matrix:

The volume resistivity of the matrix can be measured with microprobes on thin sections prepared from the conductive layer. A means that can produce a very thin sample, such as a microtome, can be used as the means for preparing the thin sections. The specific procedure is described below.

Component Factor (ii): Domain Volume Resistivity

The volume resistivity R2 of the domains is less than the volume resistivity R1 of the matrix. This facilitates restricting the charge transport pathways to pathways via a plurality of domains, while suppressing unwanted charge transport by the matrix.

The volume resistivity R1 is preferably at least $1.0\times10^{5}$-times the volume resistivity R2. R1 is more preferably $1.0\times10^{5}$-times to $1.0\times10^{18}$-times R2, still more preferably $1.0\times10^{6}$-times to $1.0\times10^{17}$-times R2, and even more preferably $8.0\times10^{6}$-times to $1.0\times10^{16}$-times R2.

In addition, R2 is preferably from $1.00\times10^{1}$ Ω·cm to $1.00\times10^{4}$ Ω·cm and more preferably from $1.00\times10^{1}$ Ω·cm to $1.00\times10^{2}$ Ω·cm.

By satisfying the preceding, the charge transport paths within the conductive layer can be controlled and a microdischarge is more easily achieved. Due to this, the electrostatic attachment of the untransferred toner to the surface of the conductive member can be better suppressed and as a consequence fogging and component contamination can be suppressed and the image density stability and image density uniformity are improved.

The volume resistivity of the domains may be adjusted, for example, by bringing the conductivity of the rubber component of the domains to a prescribed value by changing the type and amount of the electronic conductive agent.

A rubber composition containing a rubber component for use for the matrix can be used as the rubber material for the domains. In order to form a matrix-domain structure, the difference in the solubility parameter (SP value) from the rubber material forming the matrix is preferably brought into a prescribed range. That is, the absolute value of the difference between the SP value of the first rubber and the SP value of the second rubber is preferably from 0.4 $(J/cm^3)^{0.5}$ to 5.0 $(J/cm^3)^{0.5}$ and more preferably from 0.4 $(J/cm^3)^{0.5}$ to 2.2 $(J/cm^3)^{0.5}$.

The domain volume resistivity can be adjusted through judicious selection of the type of electronic conducting agent and its amount of addition. With regard to the electronic conducting agent used to control the domain volume resistivity to from $1.00\times10^1$ Ω·cm to $1.00\times10^4$ Ω·cm, preferred electronic conducting agents are those that can bring about large variations in the volume resistivity, from a high resistance to a low resistance, as a function of the amount that is dispersed.

The electronic conducting agent blended in the domains can be exemplified by carbon black; graphite; oxides such as titanium oxide, tin oxide, and so forth; metals such as Cu, Ag, and so forth; and particles rendered conductive by coating the surface with an oxide or metal. As necessary, a blend of suitable quantities of two or more of these conducting agents may be used.

Among these electronic conducting agents, the use is preferred of conductive carbon black, which has a high affinity for rubber and supports facile control of the electronic conducting agent-to-electronic conducting agent distance. There are no particular limits on the type of carbon black blended into the domains. Specific examples are gas furnace black, oil furnace black, thermal black, lamp black, acetylene black, and Ketjenblack.

Among the preceding, a conductive carbon black having a DBP absorption from 40 $cm^3$/100 g to 170 $cm^3$/100 g, which can impart a high conductivity to the domains, can be favorably used.

The content of the electronic conducting agent, e.g., conductive carbon black, is preferably from 20 mass parts to 150 mass parts per 100 mass parts of the second rubber contained in the domains. From 50 mass parts to 100 mass parts is more preferred.

The conducting agent is preferably blended in larger amounts than for ordinary electrophotographic conductive members. Doing this makes it possible to easily control the volume resistivity of the domains into the range from $1.00\times10^1$ Ω·cm to $1.00\times10^4$ Ω·cm.

The fillers, processing aids, co-crosslinking agents, crosslinking accelerators, ageing inhibitors, crosslinking co-accelerators, crosslinking retarders, softeners, dispersing agents, colorants, and so forth that are ordinarily used as rubber blending agents may as necessary be added to the rubber composition for the domains within a range in which the effects according to the present disclosure are not impaired.

Method for Measuring the Volume Resistivity of the Domains:

Measurement of the volume resistivity of the domains may be carried out using the same method as the method for measuring the volume resistivity of the matrix, but changing the measurement location to a location corresponding to a domain and changing the voltage applied during measurement of the current value to 1 V. The specific procedure is described below.

Component Factor (iii): Distance Between Adjacent Walls of the Domains>

From the standpoint of bringing about charge transfer between domains, the arithmetic-mean value Dm of the distance between adjacent walls of the domains (also referred to herebelow simply as the "interdomain distance Dm"), in observation of the cross section in the thickness direction of the conductive layer, is preferably not more than 2.00 μm and more preferably not more than 1.00 μm.

In addition, in order for the domains to be securely electrically partitioned from one another by an insulating region (matrix) and enable charge to be readily accumulated by the domains, the interdomain distance Dm is preferably at least 0.15 μm and more preferably at least 0.20 μm.

Method for Measuring the Interdomain Distance Dm:

Measurement of the interdomain distance Dm may be carried out using the following method.

First, a section is prepared using the same method as the method used in measurement of the volume resistivity of the matrix, supra. In order to favorably carry out observation of the matrix-domain structure, a pretreatment that provides good contrast between the conductive phase and insulating phase may be carried out, e.g., a staining treatment, vapor deposition treatment, and so forth.

The presence of a matrix-domain structure is checked by observation using a scanning electron microscope (SEM) of the section after formation of a fracture surface and platinum vapor deposition. The SEM observation is preferably carried out at 5,000× from the standpoint of the accuracy of quantification of the domain area. The specific procedure is described below.

Uniformity of the Interdomain Distance Dm:

The interdomain distance Dm preferably has a uniform distribution in order to enable the formation of a more stable microdischarge. Having a uniform distribution for the interdomain distance Dm makes it possible to reduce phenomena that impair the ease of electrical discharge elaboration, e.g., the occurrence of locations where charge supply is delayed relative to the surroundings due to the presence to some degree of locations within the conductive layer where the interdomain distance is locally longer.

Figure 3A:
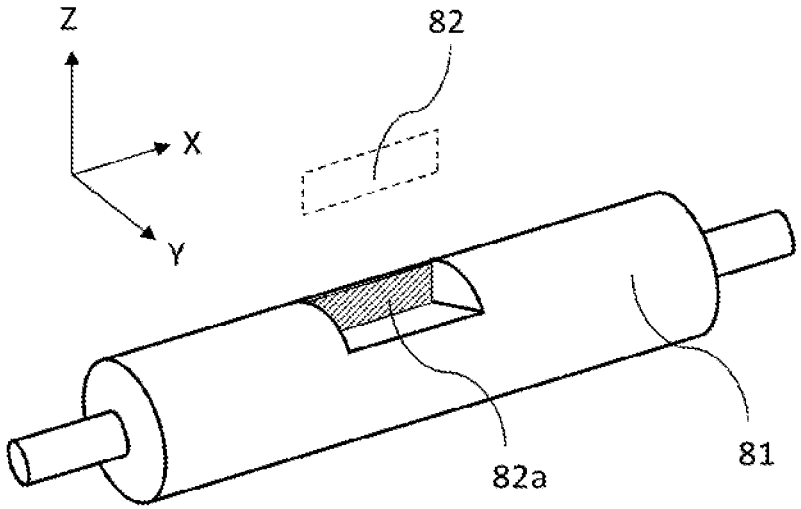
FIGS. 3A and 3B are explanatory diagrams of a charging roller for the direction of cross section excision from the conductive layer.
Figure 3B:
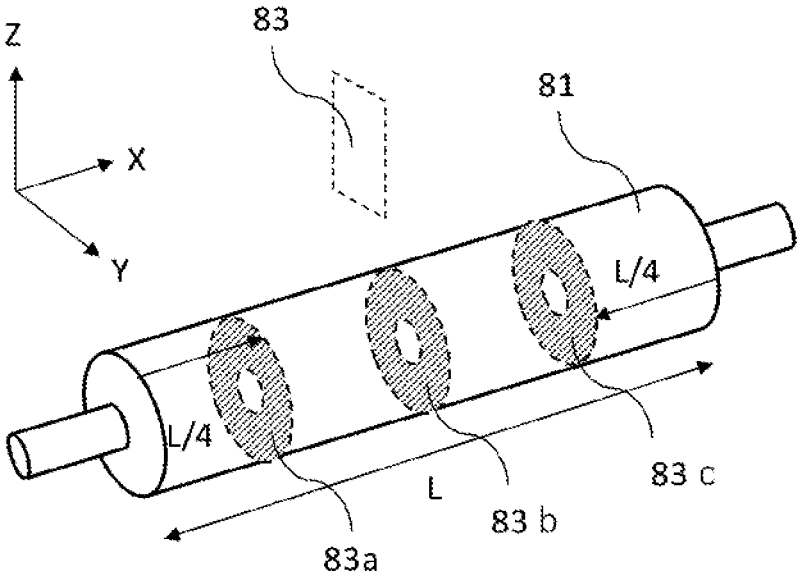

Operating in the charge transport cross section, i.e., the cross section in the thickness direction of the conductive layer as shown in FIG. 3B, a 50 μm-square region of observation is taken at three randomly selected locations in the thickness region at a depth of 0.1T to 0.9T from the outer surface of the conductive layer in the direction of the support. In this case, and using the interdomain distance Dm within these regions of observation and the standard deviation am of the distribution of the interdomain distance, the variation coefficient am/Dm for the interdomain distance is preferably from 0 to 0.40 and is more preferably from 0.10 to 0.30.

Method for Measuring the Uniformity of the Interdomain Distance Dm:

The uniformity of the interdomain distance can be measured by quantification of the image obtained by direct observation of the fracture surface as in the measurement of the interdomain distance. The specific procedure is described below.

The conductive member can be formed, for example, via a method including the following steps (i) to (iv):

step (i): a step of preparing a domain-forming rubber mixture (also referred to hereafter as "CMB") containing carbon black and a second rubber;

step (ii): a step of preparing a matrix-forming rubber mixture (also referred to hereafter as "MRC") containing a first rubber;

step (iii): a step of preparing a rubber mixture having a matrix-domain structure by kneading the CMB with the MRC; and step (iv): a step of forming a conductive layer by forming a layer of the rubber mixture prepared in step (iii) on a conductive support, either directly thereon or via another layer, and curing the rubber mixture layer.

Component factors (i) to (iii) can be controlled, for example, through the selection of the materials used in the individual steps described above and through adjustment of the production conditions. This is described in the following.

First, with regard to component factor (i), the volume resistivity of the matrix is governed by the composition of the MRC.

Low-conductivity rubbers are preferred for the first rubber that is used in the MRC. At least one selection from the group consisting of natural rubber, butadiene rubber, butyl rubber, acrylonitrile-butadiene rubber, urethane rubber, silicone rubber, fluorocarbon rubber, isoprene rubber, chloroprene rubber, styrene-butadiene rubber, ethylene-propylene rubber, ethylene-propylene-diene rubber, and polynorbornene rubber is preferred.

The first rubber is more preferably at least one selection from the group consisting of butyl rubber, styrene-butadiene rubber, and ethylene-propylene-diene rubber.

The following may be added to the MRC on an optional basis as long as the volume resistivity of the matrix is in the range given above: fillers, processing aids, crosslinking agents, co-crosslinking agents, crosslinking accelerators, crosslinking co-accelerators, crosslinking retarders, ageing inhibitors, softeners, dispersing agents, colorants, and so forth. On the other hand, in order to bring the matrix volume resistivity into the range indicated above, an electronic conducting agent, e.g., carbon black, is preferably not incorporated in the MRC.

In relation to component factor (ii), the domain volume resistivity R2 can be adjusted using the amount of the electronic conducting agent in the CMB. For example, considering the example of the use as the electronic conducting agent of a conductive carbon black having a DBP absorption of from 40 $cm^3$/100 g to 170 $cm^3$/100 g, the desired range can be achieved by preparing a CMB that contains from 40 mass parts to 200 mass parts of the conductive carbon black per 100 mass parts of the second rubber in the CMB.

In addition, controlling the following (a) to (d) is effective with regard to the state of domain dispersion in relation to component factor (iii):

(a) the difference between the interfacial tensions $\sigma$ of the CMB and the MRC;

(b) the ratio between the viscosity of the MRC ($\eta m$) and the viscosity of the CMB ($\eta d$) ($\eta m/\eta d$);

(c) the shear rate ($\gamma$) and the amount of energy during shear (EDK) when the CMB and the MRC are kneaded in step (iii); and (d) the volume fraction of the CMB relative to the MRC in step (iii).

(a) The Difference in Interfacial Tension Between the CMB and the MRC

Phase separation generally occurs when two species of incompatible rubbers are mixed. This occurs because the interaction between the same species of polymer molecules is stronger than the interaction between different species of polymer molecules, resulting in aggregation between the same species of polymer molecules, a reduction in free energy, and stabilization.

The interface in a phase-separated structure, due to contact with a different species of polymer molecules, assumes a higher free energy than the interior, which is stabilized by the interaction between polymer molecules of the same species. As a result, in order to lower the interfacial free energy, an interfacial tension occurs directed to reducing the area of contact with the different species of polymer molecules. When this interfacial tension is small, this moves in the direction of a more uniform mixing, even by different species of polymer molecules, to increase the entropy. A uniformly mixed state is dissolution, and there is a tendency for the interfacial tension to correlate with the SP value (solubility parameter), which is a metric for solubility.

Thus, the difference in interfacial tension between the CMB and the MRC is thought to correlate with the difference in the SP values of the rubbers contained by each. Rubbers are preferably selected whereby the absolute value of the difference between the solubility parameter SP value of the first rubber in the MRC and the SP value of the second rubber in the CMB is preferably from 0.4 $(J/cm^3)^{0.5}$ to 5.0 $(J/cm^3)^{0.5}$ and is more preferably from 0.4 $(J/cm^3)^{0.5}$ to 2.2 $(J/cm^3)^{0.5}$. Within this range, a stable phase-separated structure can be formed and a small CMB domain diameter can be established.

Specific preferred examples of second rubbers that can be used in the CMB here are, for example, at least one selection from the group consisting of natural rubber (NR), isoprene rubber (IR), butadiene rubber (BR), acrylonitrile-butadiene rubber (NBR), styrene-butadiene rubber (SBR), butyl rubber (IIR), ethylene-propylene rubber (EPM), ethylene-propylene-diene rubber (EPDM), chloroprene rubber (CR), nitrile rubber (NBR), hydrogenated nitrile rubber (H-NBR), silicone rubber, and urethane rubber (U).

The second rubber is more preferably at least one selection from the group consisting of styrene-butadiene rubber (SBR), butyl rubber (IIR), and acrylonitrile-butadiene rubber (NBR) and is still more preferably at least one selection from the group consisting of styrene-butadiene rubber (SBR), and butyl rubber (IIR).

The thickness of the conductive layer is not particularly limited as long as the desired functions and effects are obtained for the conductive member. The thickness of the conductive layer is preferably from 1.0 mm to 4.5 mm.

The mass ratio between the domains and the matrix (domain:matrix) is preferably 5:95 to 40:60, more preferably 10:90 to 30:70, and still more preferably 13:87 to 25:75.

Method for Measuring the SP Value

The SP value can be determined with good accuracy by constructing a calibration curve using materials having already known SP values. Catalogue values provided by the material manufacturers may also be used as these already known SP values. For example, for NBR and SBR, the SP value is almost entirely determined by the content ratio for the acrylonitrile and styrene independently of the molecular weight.

Accordingly, the content ratio for acrylonitrile or styrene for the rubber constituting the matrix and domains is analyzed using an analytic procedure, e.g., pyrolysis gas chromatography (Py-GC) and solid-state NMR. By doing this, the SP value can be determined from a calibration curve obtained from materials for which the SP value is already known.

In addition, with an isoprene rubber, the SP value is governed by the isomer structure, e.g., 1,2-polyisoprene, 1,3-polyisoprene, 3,4-polyisoprene, cis-1,4-polyisoprene, trans-1,4-polyisoprene, and so forth. Thus, the isomer content ratio is analyzed using, e.g., Py-GC and solid-state NMR, as for SBR and NBR and the SP value can be determined from materials for which the SP value is already known.

The SP values of materials having already known SP values are determined using the Hansen sphere method.

(b) Viscosity Ratio Between the CMB and the MRC

The domain diameter declines as the viscosity ratio between the CMB and the MRC (CMB/MRC) ($\eta d/\eta m$)

approaches 1. Specifically, this viscosity ratio is preferably from 1.0 to 2.0. The viscosity ratio between the CMB and the MRC can be adjusted through selection of the Mooney viscosity of the starting rubbers used for the CMB and the MRC and through the filler type and its amount of incorporation.

A plasticizer, e.g., paraffin oil, may also be added to the extent this does not hinder the formation of a phase-separated structure. The viscosity ratio may also be adjusted by adjusting the temperature during kneading.

The viscosity of the rubber mixture for domain formation and the viscosity of the rubber mixture for matrix formation are obtained by measurement of the Mooney viscosity $ML_{(1+4)}$ based on JIS K 6300-1:2013; the measurement is performed at the temperature of the rubber during kneading.

(c) The Shear Rate and the Amount of Energy During Shear when the CMB is Kneaded with the MRC The interdomain distance Dm becomes smaller as the shear rate during kneading of the CMB with the MRC becomes faster and as the amount of energy during shear becomes larger.

The shear rate can be increased by increasing the inner diameter of the stirring members of the kneader, i.e., the blades and screw, to reduce the gap between the end face of the stirring members and the inner wall of the kneader, and by raising the rotation rate. An increase in the energy during shear can be achieved by raising the rotation rate of the stirring members and raising the viscosity of the first rubber in the CMB and the second rubber in the MRC.

(d) Volume Fraction of the CMB Relative to the MRC

The volume fraction of the CMB relative to the MRC correlates with the collisional coalescence probability for the domain-forming rubber mixture relative to the matrix-forming rubber mixture. Specifically, when the volume fraction of the domain-forming rubber mixture relative to the matrix-forming rubber mixture is reduced, the collisional coalescence probability for the domain-forming rubber mixture and matrix-forming rubber mixture declines. Thus, the interdomain distance Dm can be made smaller by lowering the volume fraction of the domains in the matrix in the range in which the required conductivity is obtained.

The volume ratio of the CMB relative to the MRC (that is, the volume ratio of the domains to the matrix) is preferably from 15% to 40%.

Using L for the length in the longitudinal direction of the conductive layer in the conductive member and using T for the thickness of this conductive layer, cross sections in the thickness direction of the conductive layer are acquired, as shown in FIG. 3B, at three locations, i.e., at the center in the longitudinal direction of the conductive layer and at L/4 toward the center from both ends of the conductive layer. The following are preferably satisfied at each of the thickness direction cross sections in the conductive layer.

At each of these cross sections, a 15 μm-square region of observation is set up at three randomly selected locations in the thickness region at a depth of 0.1T to 0.9T from the outer surface of the conductive layer, and preferably at least 80 number % of the domains observed at each of all nine regions of observation satisfies the following component factors (iv) and (v).

Component Factor (iv)

The percentage μr for the cross-sectional area of the electronic conducting agent present in a domain with respect to the cross-sectional area of the domain is at least 20%.

Component Factor (v)

A/B is from 1.00 to 1.10 where A is the periphery length of the domain and B is the envelope periphery length of the domain.

Component factors (iv) and (v) can be regarded as specifications related to domain shape. This "domain shape" is defined as the cross-sectional shape of the domain visualized in the cross section in the thickness direction of the conductive layer.

The domain shape is preferably a shape that lacks unevenness in its peripheral surface, i.e., is a shape approximating a sphere. Reducing the number of uneven structures associated with the shape can reduce nonuniformity of the electric field between domains, i.e., can reduce locations where electric field concentration is produced and can reduce the phenomenon of the occurrence of unwanted charge transport in the matrix.

The present inventors have found that the amount of electronic conducting agent contained in one domain exercises an effect on the external shape of that domain. That is, it was found that, as the amount of loading of one domain with the electronic conducting agent increases, the external shape of that domain becomes closer to that of a sphere. A larger number of near-spherical domains results in ever fewer concentration points for electron transfer between domains.

Moreover, according to investigations by the present inventors, a near-spherical shape is better assumed by domains for which the total percentage μr, with reference to the area of the cross section of one domain, for the cross-sectional area of the electronic conducting agent observed in that cross section is at least 20%.

As a result, an external shape can be assumed that can significantly relax the concentration of electron transfer between domains, and this is thus preferred. Specifically, the percentage μr, with reference to the area of the cross section of a domain, for the cross-sectional area of the electronic conducting agent present in that domain is preferably at least 20%. 25% to 30% is more preferred.

A satisfactory amount of charge supply is made possible, even in high-speed processes, by satisfying the aforementioned range.

The present inventors discovered that the following formula (5) is preferably satisfied in relation to a shape that lacks unevenness on the peripheral surface of the domain.

$$1.00 \leq A/B \leq 1.10 \quad (5)$$

(A: periphery length of domain, B: envelope periphery length of domain)

Figure 6:
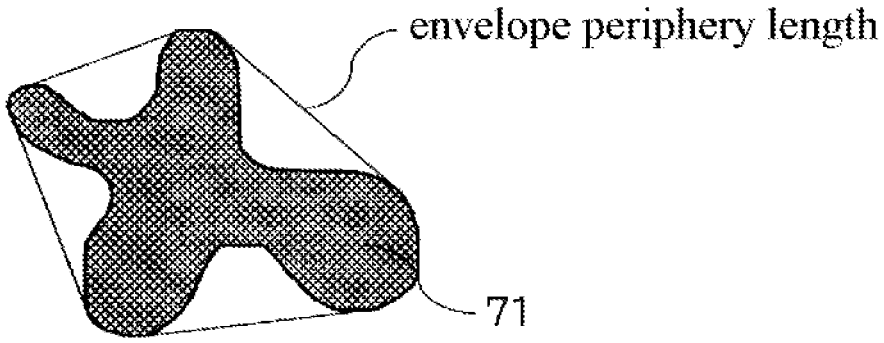
FIG. 6 is an explanatory diagram of the envelope periphery length of a domain.

Formula (5) indicates the ratio between the domain periphery length A and the domain envelope periphery length B. The envelope periphery length here is the periphery length, as shown in FIG. 6, when the protruded portions of a domain 71 observed in a region of observation are connected.

The ratio between the domain periphery length and domain envelope periphery length has a minimum value of 1, and a value of 1 indicates that the domain has a shape that lacks depressed portions in its cross-sectional shape, e.g., a perfect circle, ellipse, and so forth. When this ratio is equal to or less than 1.1, this indicates that large uneven shapes are not present in the domain and the expression of electric field anisotropy is suppressed.

Method for Measuring Each of the Parameters Related to Domain Shape

An ultrathin section having a thickness of 1 μm is sectioned out at an excision temperature of −100° C. from the conductive layer of the conductive member (conductive roller) using a microtome (product name: Leica EMFCS, Leica Microsystems GmbH). However, as indicated in the following, evaluation of the domain shape must be carried out on the fracture surface of a section prepared using a cross section orthogonal to the longitudinal direction of the conductive member. The reason for this is as follows.

FIG. 3A and FIG. 3B give diagrams that show the shape of a conductive member 81 using three axes and specifically the X, Y, and Z axes in three dimensions. The X axis in FIG. 3A and FIG. 3B shows the direction parallel to the longitudinal direction (axial direction) of the conductive member, and the Y axis and Z axis show the directions orthogonal to the axial direction of the conductive member.

FIG. 3A shows an image diagram for a conductive member, in which the conductive member has been cut out at a cross section 82*a* that is parallel to the XZ plane 82. The XZ plane can be rotated 3600 centered on the axis of the conductive member. Considering that the conductive member rotates abutting a photosensitive drum and discharges upon the passage of a gap with the photosensitive drum, the cross section 82*a* parallel to the XZ plane 82 thus indicates a plane where discharge occurs simultaneously with a certain timing. The surface potential of the photosensitive drum is formed by the passage of a plane corresponding to a certain portion of the cross section 82*a*.

Accordingly, in order to evaluate the domain shape, which correlates with concentration of the electric field within the conductive member, rather than analysis of a cross section where discharge occurs simultaneously in a certain instant such as the cross section 82*a*, evaluation is required at a cross section parallel to the YZ plane 83 orthogonal to the axial direction of the conductive member, which enables evaluation of a domain shape that contains a certain portion of the cross section 82*a*.

Using L for the length of the conductive layer in the longitudinal direction, a total of three locations are selected for this evaluation, i.e., the cross section 83*b* at the center in the longitudinal direction of the conductive layer and cross sections (83*a* and 83*c*) at two positions that are L/4 toward the center from either end of the conductive layer.

In addition, in relation to the location of observation in cross sections 83*a* to 83*c* and using T for the thickness of the conductive layer, the measurement should be carried out at a total of nine regions of observation wherein a 15 μm-square region of observation is taken at three randomly selected locations in the thickness region at a depth of 0.1T to 0.9T from the outer surface of each section.

Vapor-deposited sections are obtained by executing platinum vapor deposition on the obtained sections. The surface of the vapor-deposited section is then magnified 1,000× or 5,000× using a scanning electron microscope (SEM) (product name: S-4800, Hitachi High-Technologies Corporation) and an observation image is acquired.

In order to quantify the domain shapes in this analysis image, a 256-gradation monochrome image is then obtained by carrying out 8-bit grey scale conversion using image processing software (product name: Image-Pro Plus, Media Cybernetics, Inc.). White/black reversal processing is subsequently carried out on the image so the domains in the fracture surface become white and a binarized image is obtained.

Method for Measuring the Cross-Sectional Area Percentage μr for the Electronic Conducting Agent in the Domain The cross-sectional area percentage for the electronic conducting agent in a domain can be measured by quantification of the binarized image of the aforementioned observation image that has been magnified 5,000×.

A 256-gradation monochrome image is obtained by carrying out 8-bit grey scale conversion using image processing software (product name: Image-Pro Plus, Media Cybernetics, Inc.). A binarized image is obtained by binarizing the observation image so as to enable differentiation of the carbon black particles. The following are determined using the count function on the obtained image: the cross-sectional area S of the domains within the analysis image and the total cross-sectional area Sc of the carbon black particles, i.e., the electronic conducting agent, present in the domains.

The arithmetic-mean value μr of Sc/S at the nine locations is calculated to give the cross-sectional area percentage for the electronic conductive material in the domains.

The cross-sectional area percentage μr of the electronic conducting agent influences the uniformity of the domain volume resistivity. The uniformity of the domain volume resistivity can be measured as follows in combination with the measurement of the cross-sectional area percentage μr.

Using the measurement method described in the preceding, σr/μr is calculated, as a metric of the uniformity of domain volume resistivity, from μr and the standard deviation σr for μr.

Method for Measuring the Periphery Length A and the Envelope Periphery Length B of the Domains Using the count function of the image processing software, the following items are determined on the domain population present in the binarized image of the aforementioned observation image that had been magnified 1,000×.

periphery length A (μm)

envelope periphery length B (μm)

These values are substituted into the following formula (5), and the arithmetic-mean value for the evaluation images at the nine locations is used.

$$1.00 \leq A/B \leq 1.10 \quad (5)$$

(A: periphery length of domain, B: envelope periphery length of domain)

Method for Measuring the Domain Shape Index

The domain shape index may be determined as the number percentage, with reference to the total number of domains, for the domain population that has a μr (area %) of at least 20% and a domain periphery length ratio A/B that satisfies the preceding formula (5). The domain shape index is preferably from 80 number % to 100 number %.

Using the count function of the image processing software (product name: Image-Pro Plus, Media Cybernetics, Inc.) on the binarized image described above, the size of the domain population within the binarized image is determined and the number percentage of the domains that satisfy μr≥20 and the preceding formula (5) may also be acquired.

By implementing a high density loading by the electronic conducting agent in a domain, as stipulated by component factor (iv), the external shape of the domain can be brought close to that of a sphere, and a low unevenness as stipulated in component factor (v) can also be established.

In order to obtain domains densely loaded with the electronic conducting agent, as stipulated by component factor (iv), the electronic conducting agent preferably has carbon black having a DBP absorption from 40 $cm^3$/100 g to 80 $cm^3$/100 g.

The DBP absorption ($cm^3$/100 g) is the volume of dibutyl phthalate (DBP) that can be absorbed by 100 g of a carbon black and is measured in accordance with Japanese Industrial Standard (JIS) K 6217-4: 2017 (Carbon black for rubber industry—Fundamental characteristics—Part 4: Determination of oil absorption number (including compressed samples)).

Carbon blacks generally have a floc-like higher-order structure in which primary particles having an average particle diameter from 10 nm to 50 nm are aggregated. This floc-like higher-order structure is referred to as "structure", and its extent is quantified by the DBP absorption ($cm^3/100$ g).

A conductive carbon black having a DBP absorption in the indicated range has an undeveloped level of structure, and due to this there is little aggregation of the carbon black and the dispersibility in rubber is excellent. As a consequence, a high loading level in the domains can be achieved, and as a result domains having an external shape more nearly approaching spherical are readily obtained.

In addition, a conductive carbon black having a DBP absorption in the indicated range is resistant to aggregate formation, and as a consequence the formation of domains according to factor (v) is facilitated.

The Domain Diameter D

The arithmetic-mean value of the circle-equivalent diameter D (also referred to herebelow simply as the "domain diameter D") of the domains observed in the cross section of the conductive layer is preferably from 0.10 μm to 5.00 μm.

When this range is adopted, the surfacemost domains assume a size equal to or less than that of the toner, and as a result a fine electrical discharge is made possible and achieving a uniform electrical discharge is facilitated.

By having the average value of the domain diameter D be at least 0.10 μm, the charge movement pathways in the conductive layer can be more effectively limited to the desired pathways. At least 0.15 μm is more preferred, and at least 0.20 μm is still more preferred.

By having the average value of the domain diameter D be not more than 5.00 μm, the proportion of the domain surface area to its total volume, i.e., the domain specific surface area, can be exponentially increased and the efficiency of charge discharge from the domains can be very substantially increased. For this reason, the average value of the domain diameter D is preferably not more than 2.00 μm and is more preferably not more than 1.00 μm.

By having the average value of the domain diameter D be not more than 2.00 μm, the electrical resistance of the domain itself can be reduced and due to this the amount of the single-event electrical discharge is brought to the necessary and sufficient amount and a more efficient microdischarge is made possible.

Viewed from the standpoint of pursuing further reductions in electric field concentration between domains, the external shape of the domains preferably more nearly approaches that of a sphere. Due to this, smaller domain diameters within the aforementioned range are preferred. The method for this can be exemplified by kneading the MRC with the CMB in step (iv) to induce phase separation between the MRC and the CMB. Another exemplary method is to exercise control, in the step of preparing a rubber mixture in which CMB domains are formed in the MRC matrix, so as to provide a small CMB domain diameter.

By providing a small CMB domain diameter, the specific surface area of the CMB is increased and the interface with the matrix is enlarged, and due to this a tension acts directed to reducing the tension at the interface of the CMB domain. As a result, the external shape of the CMB domain more nearly approaches that of a sphere.

Taylor's formula (formula (6)), Wu's empirical formulas (formulas (7) and (8)), and Tokita's formula (formula (9)) are known with regard to the factors that govern the domain diameter in a matrix-domain structure formed when two species of incompatible polymers are melt-kneaded.

Taylor's formula $$D=[C\cdot\sigma/\eta m\cdot\gamma]\cdot f(\eta m/\eta d) \quad (6)$$

Wu's empirical formulas $$\gamma\cdot D\cdot\eta m/\sigma=4(\eta d/\eta m)0.84\cdot\eta d/\eta m>1 \quad (7)$$

$$\gamma\cdot D\cdot\eta m/\sigma=4(\eta d/\eta m)-0.84\cdot\eta d/\eta m<1 \quad (8)$$

Tokita's formula $$D=12\cdot P\cdot\sigma\cdot\phi/(\pi\cdot\eta\cdot\gamma)\cdot(1+4\cdot P\cdot\phi\cdot EDK/(\pi\cdot\eta\cdot\gamma)) \quad (9)$$

In formulas (6) to (9), D represents the maximum Feret diameter of the CMB domains; C represents a constant; σ represents interfacial tension; ηm represents the viscosity of the matrix; ηd represents the viscosity of the domains; γ represents the shear rate; η represents the viscosity of the mixed system; P represents the collisional coalescence probability; ϕ represents the domain phase volume; and EDK represents the domain phase severance energy.

In order, in relation to component factor (iii), to provide a uniform interdomain distance, it is effective to provide a small domain diameter in accordance with formulas (6) to (9). In addition, in the process, during the step of kneading the MRC with the CMB, of dividing up the starting rubber for the domains and gradually reducing the particle diameter thereof, the interdomain distance also varies depending on when the kneading step is halted.

Accordingly, the uniformity of the interdomain distance can be controlled using the kneading time in the kneading step and using the kneading rotation rate, which is an index for the intensity of this kneading, and the uniformity of the interdomain distance can be enhanced using a longer kneading time and a larger kneading rotation rate.

Uniformity of the Domain Diameter D:

The domain diameter D is preferably uniform and thus the particle size distribution is preferably narrow. By having a uniform distribution for the domain diameter D traversed by the charge in the conductive layer, charge concentration within the matrix-domain structure is suppressed and the ease of emanation of the electric discharge over the entire surface of the conductive member can be effectively increased.

When, operating in the charge transport cross section, i.e., the cross section in the thickness direction of the conductive layer as shown in FIG. 3B, a 50 μm-square region of observation is taken at three randomly selected locations in the thickness region at a depth of 0.1T to 0.9T from the outer surface of the conductive layer in the direction of the support, the σd/D ratio for the standard deviation σd of the domain diameter and the arithmetic-mean value D of the domain diameter (variation coefficient σd/D) is preferably from 0 to 0.40 and is more preferably from 0.10 to 0.30.

To bring about a better uniformity of the domain diameter, the uniformity of the domain diameter is also enhanced when a small domain diameter is established in accordance with formulas (6) to (9), which is equivalent to the aforementioned procedure for enhancing the uniformity of the interdomain distance. Moreover, in the process, during the step of kneading the MRC with the CMB, of dividing up the starting rubber for the domains and gradually reducing the particle diameter thereof, the uniformity of the domain diameter also varies depending on when the kneading step is halted.

Accordingly, the uniformity of the domain diameter can be controlled using the kneading time in the kneading step and using the kneading rotation rate, which is an index for the intensity of this kneading, and the uniformity of the domain diameter can be enhanced using a longer kneading time and a larger kneading rotation rate.

Method for Measuring the Uniformity of the Domain Diameter

The uniformity of the domain diameter can be measured by quantification of the image obtained by direct observation of the fracture surface, which is obtained by the same method for measurement of the uniformity of the interdomain distance as described above. The specific procedure is described below.

Method for Confirming the Matrix-Domain Structure

The presence of a matrix-domain structure in the conductive layer can be confirmed by preparing a thin section of the conductive layer and carrying out a detailed observation of the fracture surface formed on the thin section. The specific procedure is described below.

Martens Hardness

At least a portion of the plurality of domains dispersed in the matrix are exposed at the outer surface of the conductive member. The outer surface of the conductive member is therefore constituted of the matrix and the exposed portions of the domains.

Defining G1 as the Martens hardness determined by the method described below for indenter contact with the matrix exposed at the outer surface of the conductive member, and defining G2 as the Martens hardness determined by the method described below for indenter contact with a domain exposed at the outer surface of the conductive member, G1 and G2 are both in the range from 1.0 $N/mm^2$ to 10.0 $N/mm^2$ and satisfy the relationship $G1<G2$.

The Martens hardnesses G1 and G2 are not parameters that represent the hardness of the matrix as a bulk phase or the hardness of the domains as a bulk phase, but rather are parameters that represent the hardnesses of the conductive layer at the matrix portions and exposed domain portions that form the outer surface of the conductive layer.

That is, the Martens hardness measured from the outer surface of the conductive layer governs the pressure received by the toner when the toner located on this outer surface is pressed in the nip formed by the electrophotographic photosensitive member and the conductive member. By having this G1 and G2 both be in the range from 1.0 $N/mm^2$ to 10.0 $N/mm^2$, deformation in this nip is suppressed even with the toner according to the present disclosure.

In addition, having the relationship $G1<G2$ be satisfied means that the outer surface of the conductive member does not have a uniform hardness. It is thought that the toner attached to this outer surface then undergoes rolling even more readily. As a result, it is thought that, combined with the microdischarge effects brought about by the aforementioned component factors (i) and (ii), the untransferred toner can be even more uniformly negatively charged.

G1 is preferably 1.0 $N/mm^2$ to 8.0 $N/mm^2$ and is more preferably 2.0 $N/mm^2$ to 7.0 $N/mm^2$.

G2 is preferably 1.5 $N/mm^2$ to 10.0 $N/mm^2$ and is more preferably 2.5 $N/mm^2$ to 8.0 $N/mm^2$.

G2–G1 is preferably 0.2 $N/mm^2$ to 8.0 $N/mm^2$ and is more preferably 0.4 $N/mm^2$ to 6.0 $N/mm^2$.

The Martens hardnesses G1 and G2 can be controlled through, for example, the properties of the first rubber constituting the matrix, the degree of crosslinking of the first rubber, the type of additives for the matrix, the amount of addition of these additives, the properties of the second rubber constituting the domains, the degree of crosslinking of the second rubber, the amount of electronic conductive agent in the domains, and the abundance of the domains in the matrix.

G1 and G2 preferably are controlled primarily through the degree of crosslinking of the first rubber.

From the viewpoint of bringing G1 and G2 into the ranges indicated above, the degree of crosslinking of the rubbers can be adjusted specifically through the types and amounts of addition of the vulcanizing agents and vulcanization accelerators. For example, sulfur may be used as the vulcanizing agent. The amount of sulfur is preferably adjusted as appropriate in conformity with the type and amount of rubber being used. From 0.5 mass parts to 8.0 mass parts per 100 mass parts of the rubber component in the unvulcanized rubber composition is preferred.

A thorough curing of the vulcanizate can be brought about by having the amount of sulfur be at least 0.5 mass parts. In addition, the use of not more than 8.0 mass parts for the amount of sulfur can prevent the crosslinking in and hardness of the vulcanizate from becoming too high.

The vulcanization accelerator can be exemplified by thiuram types, thiazole types, guanidine types, sulfenamide types, dithiocarbamate salt types, and thiourea types. Among the preceding, thiuram-type vulcanization accelerators are preferred because they are highly effective as vulcanization accelerators in the vulcanization of the first rubber and second rubber and facilitate adjustment of G1 and G2.

Thiuram-type vulcanization accelerators can be exemplified by tetramethylthiuram disulfide (TT), tetraethylthiuram disulfide (TET), tetrabutylthiuram disulfide (TBTD), tetraoctylthiuram disulfide (TOT), and so forth.

The content of the vulcanization accelerator in the unvulcanized rubber composition is preferably from 0.5 mass parts to 4.0 mass parts of the vulcanization accelerator per 100 mass parts of the rubber component in the unvulcanized rubber composition. A satisfactory effect as a vulcanization accelerator is obtained when at least 0.5 mass parts is used. When not more than 4.0 mass parts is used, vulcanization is not overly accelerated and G1 and G2 are readily brought into the ranges indicated above.

Toner

The toner has a toner particle that contains a binder resin and a crystalline material, and has an onset temperature T(A)° C. for the storage elastic modulus E' according to powder dynamic viscoelastic measurement of not more than 80.0° C. ($T(A)\leq 80.0°$ C.).

Analysis of the toner using a powder dynamic viscoelastic measurement instrument makes it possible to observe the melting status in the vicinity of the toner surface as a function of temperature. The specific measurement procedure is described below; however, it is thought that this powder dynamic viscoelastic measurement instrument, because it enables measurement on the powder without conversion of the toner into a pellet, can analyze the softening status of the toner surface.

Investigations by the present inventors have determined that the onset temperature—as determined from a curve that gives the storage elastic modulus E' measured using such a powder dynamic viscoelastic measurement instrument—is a parameter related to and involved with the fixing performance of toner.

That is, the onset temperature T(A)° C. indicates that the temperature at which the toner begins to melt is in a certain temperature region. A toner having a high temperature for the start of melting is regarded as having a poor low-temperature fixing performance. The toner in accordance with the present disclosure has a T(A) of not more than 80.0° C. and thus has an excellent low-temperature fixability.

The instant toner preferably has a T(A)° C., i.e., the onset temperature obtained according to powder dynamic viscoelastic measurement, of at least 45.0° C. The use of at least 45.0° C. provides a superior enhancement in storability and inhibition of hot offset. T(A) is more preferably 50.0° C. to 70.0° C.

T(A) can be controlled through the use of a low-melting crystalline material that is highly compatible with the binder resin and through control of the crystalline state.

The crystalline material is preferably an ester-type crystalline material, which is superior with regard to formation of a crystalline state and in having a high compatibility with the binder resin.

The crystalline material preferably has a maximum endothermic peak in the range of 60.0° C. to 90.0° C. in measurement by differential scanning calorimetry (DSC). The use of at least 60.0° C. provides a better suppression of excessive exudation of the crystalline material and a better suppression of hot offset. The use of not more than 90.0° C., on the other hand, provides a better exudation of the crystalline material at low temperatures and a better compatibility with the binder resin and provides a superior enhancement in the low-temperature fixability. 62.5° C. to 80.0° C. is more preferred.

The relative permittivity εr of the toner is preferably at least 2.00. From 2.05 to 3.00 is more preferred, and from 2.10 to 2.40 is still more preferred. Charging inhibition during charging of the electrophotographic photosensitive member by the conductive member can be suppressed by having the relative permittivity be at least 2.00.

The relative permittivity εr of toner is thought to depend on the state of polarization of the materials in the toner, and it is thought in particular that the colorant has a large influence. Carbon black, titanium oxide, magnetic bodies, and so forth are examples of preferred colorants for controlling the relative permittivity to the values indicated above, with magnetic bodies being more preferred.

The material constituents and production methods that can be used for the toner are described in detail in the following.

The toner particle will be described in detail first.

The toner particle contains a binder resin. The binder resin can be exemplified by the following:

vinyl resins, polyester resins, polyol resins, polyvinyl chloride resins, phenolic resins, natural resin-modified phenolic resins, natural resin-modified maleic acid resins, acrylic resins, methacrylic resins, polyvinyl acetate, silicone resins, polyurethane resins, polyamide resins, furan resins, epoxy resins, xylene resins, polyvinyl butyral, terpene resins, coumarone-indene resins, and petroleum resins.

The following are preferred: vinyl resins, polyester resins, and hybrid resins provided by mixing a polyester resin with a vinyl resin or by partially reacting the two. Vinyl resins and polyester resins are more preferred.

The method for producing the toner particle is not particularly limited, and any known method, e.g., a dry method, emulsion polymerization method, dissolution suspension method, suspension polymerization method, and so forth, can be used. With regard to dry methods, a production method is preferred in which a surface-modification treatment, e.g., a thermal spheronizing treatment, is carried out; the suspension polymerization method is preferred with regard to polymerization methods. More preferred is a suspension polymerization method in which particles of a polymerizable monomer composition are formed by granulating the polymerizable monomer composition in an aqueous medium.

A radical-polymerizable vinyl monomer is used as the polymerizable monomer. A monofunctional monomer or multifunctional monomer may be used as the vinyl monomer. These monomers can be used for vinyl resins.

The monofunctional monomer can be exemplified by styrene; styrene derivatives such as α-methylstyrene, β-methylstyrene, o-methylstyrene, m-methylstyrene, p-methylstyrene, p-methoxystyrene, and p-phenylstyrene; acrylic polymerizable monomers such as methyl acrylate, ethyl acrylate, n-propyl acrylate, iso-propyl acrylate, n-butyl acrylate, dibutyl phosphate ethyl acrylate, and 2-benzoyloxyethyl acrylate; methacrylic polymerizable monomers such as methyl methacrylate, ethyl methacrylate, n-propyl methacrylate, iso-propyl methacrylate, n-butyl methacrylate, and dibutyl phosphate ethyl methacrylate; methylene aliphatic monocarboxylic acid esters; vinyl esters such as vinyl acetate and vinyl propionate; vinyl ethers such as vinyl methyl ether, vinyl ethyl ether, and vinyl isobutyl ether; and vinyl ketones such as vinyl methyl ketone, vinyl hexyl ketone, and vinyl isopropyl ketone.

The polymerizable monomer preferably contains, among the preceding, styrene or a styrene derivative. It more preferably contains styrene and at least one selection from the group consisting of acrylic polymerizable monomers and methacrylic polymerizable monomers.

The multifunctional monomer can be exemplified by diethylene glycol diacrylate, triethylene glycol diacrylate, tetraethylene glycol diacrylate, polyethylene glycol diacrylate, tetramethylolmethane tetramethacrylate, divinylbenzene, and divinyl ether.

A single one of these monofunctional monomers may be used by itself or at least two thereof be used in combination, or a combination of such a monofunctional monomer and multifunctional monomer may be used.

In addition, a crosslinking agent for the polymerizable monomer may also be used. In specific terms, a compound having at least two polymerizable double bonds, such as the following, is used. Examples are carboxylate esters having two double bonds, such as propylene glycol diacrylate, ethylene glycol diacrylate, 1,6-hexanediol diacrylate, and 1,3-butanediol dimethacrylate; aromatic divinyl compounds such as divinylbenzene and divinylnaphthalene; divinyl compounds such as divinylaniline, divinyl ether, divinyl sulfide, and divinyl sulfone; and compounds that have at least three vinyl groups. Viewed in terms of the coexistence of low-temperature fixability with an improved high-temperature elasticity, the use of a carboxylate ester is preferred. A single one of these crosslinking agents may be used by itself or combinations of these crosslinking agents may be used.

The amount of addition of the crosslinking agent, per 100 mass parts of the binder resin or polymerizable monomer that produces the binder resin, is preferably from 0.01 mass parts to 5.00 mass parts and is more preferably from 0.10 mass parts to 3.00 mass parts.

An oil-soluble initiator and/or a water-soluble initiator is used for the polymerization initiator. A polymerization initiator is preferred that has a half-life of from 0.5 to 30 hours at the reaction temperature of the polymerization reaction. Execution of the polymerization reaction using the addition of 0.5 to 20 mass parts per 100 mass parts of the polymerizable monomer is preferred because generally this can provide a polymer having a molecular weight maximum between 10,000 and 100,000 and can provide a toner particle having a suitable strength and melting characteristics.

The polymerization initiator can be exemplified by the following: azo and diazo polymerization initiators such as 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile, and by peroxide-type polymerization initiators such as benzoyl peroxide, t-butyl peroxy-2-ethylhexanoate, t-butyl peroxypivalate, t-butyl peroxyisobutyrate, t-butyl peroxyneodecanoate, methyl ethyl ketone peroxide, diisopropyl peroxycarbonate, cumene hydroperoxide, 2,4-dichlorobenzoyl peroxide, and lauroyl peroxide.

Known chain transfer agents, polymerization inhibitors, and so forth may also be added and used in order to control the degree of polymerization by the polymerizable monomer.

The polymerizable monomer composition may contain an amorphous polyester resin. That is, the toner particle may contain a binder resin and an amorphous polyester resin. In addition, the binder resin is also preferably an amorphous polyester resin.

The monomer for the polyester resin is exemplified by the following.

The dibasic acid component can be exemplified by the following dicarboxylic acids and derivatives thereof: benzenedicarboxylic acids and their anhydrides and lower alkyl esters, e.g., phthalic acid, terephthalic acid, isophthalic acid, and phthalic anhydride; alkyl dicarboxylic acids, e.g., succinic acid, adipic acid, sebacic acid, and azelaic acid, and their anhydrides and lower alkyl esters; alkenylsuccinic acids and alkylsuccinic acids, e.g., n-dodecenylsuccinic acid and n-dodecylsuccinic acid, and their anhydrides and lower alkyl esters; and unsaturated dicarboxylic acids, e.g., fumaric acid, maleic acid, citraconic acid, and itaconic acid, and their anhydrides and lower alkyl esters.

The dihydric alcohol component can be exemplified by the following: ethylene glycol, polyethylene glycol, 1,2-propanediol, 1,3-propanediol, 1,6-hexanediol, neopentyl glycol, 1,4-cyclohexanedimethanol (CHDM), hydrogenated bisphenol A, and bisphenol and derivatives thereof.

In addition to the aforementioned dibasic carboxylic acid component and dihydric alcohol component, the polyester resin may also contain the following as a constituent component: a monobasic carboxylic acid component, a monohydric alcohol component, an at least tribasic carboxylic acid component, and an at least trihydric alcohol component.

The monobasic carboxylic acid component can be exemplified by aromatic carboxylic acids having not more than 30 carbons, e.g., benzoic acid and p-methylbenzoic acid, and by aliphatic carboxylic acids having not more than 30 carbons, e.g., stearic acid and behenic acid.

The monohydric alcohol component can be exemplified by aromatic alcohols having not more than 30 carbons, e.g., benzyl alcohol, and by aliphatic alcohols having not more than 30 carbons, e.g., lauryl alcohol, cetyl alcohol, stearyl alcohol, and behenyl alcohol.

The at least tribasic carboxylic acid component is not particularly limited and can be exemplified by trimellitic acid, trimellitic anhydride, and pyromellitic acid.

The at least trihydric alcohol component can be exemplified by trimethylolpropane, pentaerythritol, and glycerol.

Monomer for the crystalline polyester described below may also be used.

The method for producing the amorphous polyester resin is not particularly limited, and a known method may be used.

The crystalline material preferably contains an ester group and more preferably contains an ester wax or a crystalline polyester.

Specific examples are waxes having a fatty acid ester as the main component, e.g., carnauba wax and montanic acid ester wax; waxes provided by the partial or complete deacidification of a fatty acid ester, e.g., deacidified carnauba wax; and partial esters between a polyhydric alcohol and a fatty acid, e.g., glycerol monobehenate.

Preferred among the preceding is at least one selection from the group consisting of ethylene glycol distearate, ethylene glycol arachidinate stearate, ethylene glycol stearate palmitate, butylene glycol dibehenate, butylene glycol distearate, butylene glycol arachidinate stearate, butylene glycol stearate palmitate, butylene glycol dibehenate, behenyl stearate, behenyl behenate, and so forth.

The content of the crystalline material (preferably ester wax), per 100 mass parts of the binder resin, is preferably from 1 mass parts to 60 mass parts, more preferably from 3 mass parts to 50 mass parts, and still more preferably from 10 mass parts to 35 mass parts.

Crystalline polyester may also be used as the crystalline material. The presence of crystallinity refers to the presence of a clear and distinct endothermic peak in differential scanning calorimetric measurement.

The following compounds are examples of constituent monomers.

The following dihydric alcohols are examples of the alcohol component: ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols given by the following formula (I) and their derivatives, and diols given by formula (II) below.

(I)

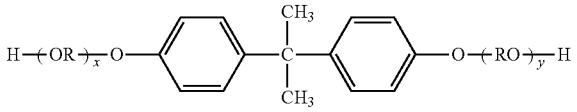

(In the formula, R represents the ethylene group or propylene group, x and y are each integers equal to or at least 0, and the average value of x+y is from 0 to 10.)

(II)

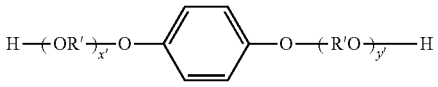

(In the formula, R' is

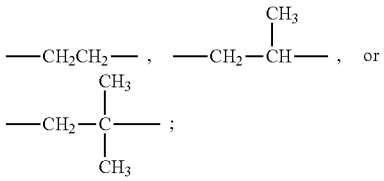

x' and y' are each integers equal to or greater than 0; and the average value of x'+y' is from 0 to 10.)

The acid component can be exemplified by dibasic carboxylic acids as follows:

benzenedicarboxylic acids and their anhydrides, such as phthalic acid, terephthalic acid, isophthalic acid, and phthalic anhydride; alkyl dicarboxylic acids such as succinic acid, adipic acid, sebacic acid, and azelaic acid, and their anhydrides; succinic acid substituted by an alkyl group having from 6 to 18 carbons or by an alkenyl group having from 6 to 18 carbons, and their anhydrides; and unsaturated dicarboxylic acids such as fumaric acid, maleic acid, citraconic acid, and itaconic acid, and their anhydrides.

The following are examples of at least tribasic polybasic carboxylic acids: 1,2,4-benzenetricarboxylic acid (trimellitic acid), 1,2,4-cyclohexanetricarboxylic acid, 1,2,4-naphthalenetricarboxylic acid, and pyromellitic acid, as well as their acid anhydrides and lower alkyl esters. Preferred thereamong are aromatic compounds, which are also highly stable versus environmental fluctuations, for example, 1,2,4-benzenetricarboxylic acid and its anhydride.

The at least trihydric polyhydric alcohol can be exemplified by 1,2,3-propanetriol, trimethylolpropane, hexanetriol, and pentaerythritol.

The ester group concentration of the crystalline material in mmol/g as given by the following formula is preferably 1.50 to 10.00, more preferably 2.00 to 10.00, and still more preferably 4.00 to 7.00. From the standpoint of enhancing the storability, the crystalline material preferably contains at least one selection from the group consisting of ester waxes and crystalline polyester, with ester waxes being more preferred.

[ester group concentration in mmol/g]=[number of moles of ester groups in the crystalline material]/[molecular weight of the crystalline material]

The molecular weight of the crystalline material is the peak molecular weight.

In addition, a hydrocarbon wax such as a low molecular weight polyethylene, low molecular weight polypropylene, microcrystalline wax, or paraffin wax may be used in the toner particle in order to improve the release performance. Specific examples are as follows:

Viscol (registered trademark) 330-P, 550-P, 660-P, and TS-200 (Sanyo Chemical Industries, Ltd.); Hi-WAX 400P, 200P, 100P, 410P, 420P, 320P, 220P, 210P, and 110P (Mitsui Chemicals, Inc.); Sasol H1, H2, C80, C105, and C77 (Schumann Sasol GmbH); HNP-1, HNP-3, HNP-9, HNP-10, HNP-11, HNP-12, and HNP-51 (Nippon Seiro Co., Ltd.); UNILIN (registered trademark) 350, 425, 550, and 700 and UNICID (registered trademark) and UNICID (registered trademark) 350, 425, 550, and 700 (Toyo ADL Corporation); and Japanese wax, beeswax, rice wax, candelilla wax, and carnauba wax (can be obtained from Cerica NODA Co., Ltd.).

The toner particle may have a core-shell structure having a shell portion in addition to a core portion. The resin forming the shell portion can be exemplified by polyesters, styrene-acrylic copolymers, and styrene-methacrylic copolymers, wherein polyester resins are preferred.

The toner contains a colorant.

Black colorants can be exemplified by carbon black and magnetic bodies as described below and by black colorants provided by color mixing yellow, magenta, and cyan colorants to produce a black color. Among the preceding, magnetic bodies are preferred from the standpoint of controlling the relative permittivity of the toner.

The magnetic body is a magnetic body in which the major component is a magnetic iron oxide such as triiron tetroxide or γ-iron oxide, and may contain an element such as phosphorus, cobalt, nickel, copper, magnesium, manganese, aluminum, or silicon. This magnetic body powder has a BET specific surface area by nitrogen adsorption of preferably from 2 to 30 $m^2/g$ and more preferably from 3 to 28 $m^2/g$. A magnetic body with a Mohs hardness of 5 to 7 is preferred. The shape of the magnetic body may be, for example, polyhedral, octahedral, hexahedral, spherical, acicular, flake, and so forth; however, low-anisotropy shapes, e.g., polyhedral, octahedral, hexahedral, and spherical, are preferred from the standpoint of increasing the image density.

The number-average particle diameter of the magnetic body is preferably 0.10 to 0.40 μm. This range is preferred from the standpoint of the balance between the tinting strength and the aggregation behavior.

The number-average particle diameter of the magnetic body can be measured using a transmission electron microscope. Specifically, the toner particles to be observed are thoroughly dispersed in an epoxy resin, and a cured material is then obtained by curing for 2 days in an atmosphere with a temperature of 40° C.

The obtained cured material is converted into a thin-section sample using a microtome, and, using a photograph at a magnification of 10,000× to 40,000× taken with a transmission electron microscope (TEM), the particle diameter of 100 magnetic bodies in the field of observation is measured. The number-average particle diameter is calculated based on the equivalent diameter of the circle equal to the projected area of the magnetic body particles. The particle diameter may also be measured using an image processing instrument.

The magnetic body can be produced, for example, using the following method. An alkali, e.g., sodium hydroxide, is added—in an amount that is an equivalent or at least an equivalent with reference to the iron component—to an aqueous solution of a ferrous salt to prepare an aqueous solution containing ferrous hydroxide. Air is blown in while keeping the pH of the prepared aqueous solution at at least pH 7, and an oxidation reaction is carried out on the ferrous hydroxide while heating the aqueous solution to at least 70° C. to first produce seed crystals that will form the core of the magnetic iron oxide particles.

An aqueous solution containing ferrous sulfate is then added, at approximately 1 equivalent based on the amount of addition of the previously added alkali, to the seed crystal-containing slurry. While maintaining the pH of the liquid at 5 to 10 and blowing in air, the reaction of the ferrous hydroxide is developed in order to grow magnetic iron oxide particles using the seed crystals as cores. At this point, the shape and magnetic properties of the magnetic body can be controlled by free selection of the pH, reaction temperature, and stirring conditions. The pH of the liquid transitions to the acidic side as the oxidation reaction progresses, but the pH of the liquid preferably does not drop below 5. The thusly obtained magnetic body is filtered, washed, and dried by standard methods to obtain the magnetic body.

In addition, when the toner is produced in an aqueous medium, a hydrophobic treatment is preferably carried out on the magnetic body surface. When the surface treatment is carried out by a dry method, treatment with a coupling agent is carried out on the magnetic body that has been washed, filtered, and dried. When the surface treatment is carried out by a wet method, the coupling treatment is carried out with redispersion of the material that has been dried after the completion of the oxidation reaction, or with redispersion, in a separate aqueous medium without drying, of the magnetic body obtained by washing and filtration after completion of the oxidation reaction. A dry method or a wet method may be selected as appropriate.

Coupling agents that can be used for the surface treatment of the magnetic body can be exemplified by silane coupling agents and titanium coupling agents. A silane coupling agent is more preferably used and is represented by the following formula (III).

$$R_mSiY_n \quad \text{(III)}$$

[In the formula, R represents an alkoxy group (having preferably from 1 to 3 carbons, more preferably 1 or 2 carbons, and still more preferably 1 carbon); m represents an integer from 1 to 3; Y represents a functional group such as an alkyl group, vinyl group, epoxy group, (meth)acryl group, and so forth; and n represents an integer from 1 to 3; with the proviso that m+n=4.]

The use is preferred of a silane coupling agent with formula (III) in which Y is an alkyl group. More preferred is an alkyl group having from 3 to 16 carbons with from 3 to 10 carbons being particularly preferred.

When such a silane coupling agent is used, the treatment may be carried out using a single silane coupling agent by itself or may be carried out using a plurality of silane coupling agents in combination. When a plurality of silane coupling agents are used in combination, a separate treatment may be carried out with each coupling agent or treatment may be carried out with all at the same time.

The total amount of treatment with the coupling agent or coupling agents used is preferably from 0.9 mass parts to 3.0 mass parts per 100 mass parts of the magnetic body. The amount of treatment agent should be adjusted in conformity with, for example, the surface area of the magnetic body, the reactivity of the coupling agent, and so forth.

Yellow colorants can be exemplified by compounds as represented by condensed azo compounds, isoindolinone compounds, anthraquinone compounds, azo-metal complexes, methine compounds, and allylamide compounds. Specific examples are as follows: C.I. Pigment Yellow 12, 13, 14, 15, 17, 62, 73, 74, 83, 93, 94, 95, 97, 109, 110, 111, 120, 128, 129, 138, 147, 150, 151, 154, 155, 168, 180, 185, and 214.

Magenta colorants can be exemplified by condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples are as follows: C.I. Pigment Red 2, 3, 5, 6, 7, 23, 48:2, 48:3, 48:4, 57:1, 81:1, 122, 146, 166, 169, 177, 184, 185, 202, 206, 220, 221, 238, 254, and 269, and C.I. Pigment Violet 19.

Cyan colorants can be exemplified by copper phthalocyanine compounds and derivatives thereof, anthraquinone compounds, and basic dye lake compounds. Specific examples are C.I. Pigment Blue 1, 7, 15, 15:1, 15:2, 15:3, 15:4, 60, 62, and 66.

A single one of these colorants may be used or a mixture may be used, and these colorants may also be used in a solid solution state. The colorant is selected considering the hue angle, chroma, lightness, lightfastness, OHP transparency, and dispersibility in the toner. The amount of colorant addition is preferably from 1 mass parts to 20 mass parts per 100 mass parts of the binder resin or polymerizable monomer that produces the binder resin.

When a magnetic body is used, its content, per 100 mass parts of the binder resin, is preferably from 35 mass parts to 100 mass parts and is more preferably from 45 mass parts to 95 mass parts.

From the standpoint of the relative permittivity of the toner, a magnetic toner containing a magnetic body as colorant is preferred.

The method of producing the toner particle using a suspension polymerization method has the following steps:

a dissolution step of obtaining a polymerizable monomer composition by the dissolution or dispersion to uniformity of binder resin-producing polymerizable monomer, crystalline material, colorant, and additional optional additives;

a granulation step of granulating this polymerizable monomer composition by dispersing it, using a suitable stirrer, in an aqueous medium that contains a dispersion stabilizer; and a polymerization step of carrying out a polymerization reaction to obtain a toner particle, optionally with the addition of an aromatic solvent or a polymerization initiator.

The following may also be employed: a cooling step that controls the size and location of occurrence of the microdomains of the crystalline material, and a holding (annealing) step that controls the degree of crystallinity of the crystalline material.

From the standpoint—in pursuit of enhancing the low-temperature fixability and the storability—of enhancing the compatibility between the crystalline material and binder resin and increasing the effect of the crystallization of the crystalline material, the conditions are preferably brought into certain prescribed ranges in the cooling step for controlling the size and location of occurrence of the microdomains of the crystalline material and the holding (annealing) step that controls the degree of crystallinity of the crystalline material.

Specifically, the cooling rate after the polymerization step is preferably from 50° C./min to 350° C./min and is more preferably from 100° C./min to 300° C./min. In addition, the temperature for the start of cooling in the cooling step is preferably from 70° C. to 100° C. The annealing temperature in the annealing step is preferably from 45° C. to 65° C.

After the completion of polymerization, the thusly obtained toner particle may be subjected to filtration, washing, and drying using known methods. The toner particle as such may be used as toner. Toner may optionally be obtained by mixing the toner particle with inorganic fine particles as a flowability improver to attach same to the toner particle surface.

Known inorganic fine particles can be used as these inorganic fine particles. The inorganic fine particles are preferably titania fine particles; silica fine particles such as silica produced by a wet method or silica produced by a dry method; or inorganic fine particles provided by carrying out a surface treatment on such a silica using, for example, a silane coupling agent, a titanium coupling agent, or silicone oil. The surface-treated inorganic fine particles preferably have a hydrophobicity, as determined by methanol titration testing, of from 30 to 98.

An example of toner particle production using a pulverization method is as follows.

In the starting material mixing step, the starting materials constituting the toner particle, i.e., the binder resin, crystalline material, colorant, other optional additives, and so forth, are metered out in prescribed quantities and are blended and mixed. The mixing apparatus can be exemplified by the double-cone mixer, V-mixer, drum mixer, Super mixer, FM mixer, Nauta mixer, Mechano Hybrid (Nippon Coke & Engineering Co., Ltd.), and so forth.

The mixed materials are then melt-kneaded to disperse the crystalline material and so forth in the binder resin. A batch kneader, e.g., a pressure kneader, Banbury mixer, and so forth, or a continuous kneader can be used in the melt-kneading step. Single-screw extruders and twin-screw extruders represent the mainstream here because they offer the advantage of enabling continuous production.

Examples here are the Model KTK twin-screw extruder (Kobe Steel, Ltd.), Model TEM twin-screw extruder (Toshiba Machine Co., Ltd.), PCM kneader (Ikegai Corp.), Twin Screw Extruder (KCK), Co-Kneader (Buss), and Kneadex (Nippon Coke & Engineering Co., Ltd.).

The resin composition obtained by melt kneading may additionally be rolled out using, for example, a two-roll mill, and cooled in a cooling step, for example, with water.

The cooled resin composition is then pulverized in a pulverization step to a desired particle diameter. In the pulverization step, for example, a coarse pulverization is performed using a grinder such as a crusher, hammer mill, or feather mill, followed by a fine pulverization using, for example, a pulverizer such as a Kryptron System (Kawasaki Heavy Industries, Ltd.), Super Rotor (Nisshin Engineering Inc.), or Turbo Mill (Freund-Turbo Corporation) or using an air jet system.

The toner particle is then obtained as necessary by carrying out classification using a sieving apparatus or a classifier, e.g., an internal classification system such as the Elbow Jet (Nittetsu Mining Co., Ltd.) or a centrifugal classification system such as the Turboplex (Hosokawa Micron Corporation), TSP Separator (Hosokawa Micron Corporation), or Faculty (Hosokawa Micron Corporation).

The toner particle may be subjected to a spheronizing treatment. For example, after pulverization a spheronizing treatment may be carried out using a Hybridization System (Nara Machinery Co., Ltd.), Mechanofusion System (Hosokawa Micron Corporation), Faculty (Hosokawa Micron Corporation), or Meteo Rainbow MR Type (Nippon Pneumatic Mfg. Co., Ltd.).

Inorganic fine particles may optionally be mixed with the obtained toner particle and thereby attached to the surface thereof as a flowability improver proceeding in the same manner as described above.

The Process Cartridge

The process cartridge has the following features.

A process cartridge detachably provided to a main body of an electrophotographic apparatus, the process cartridge including a charging unit for charging the surface of an electrophotographic photosensitive member, and a developing unit for developing an electrostatic latent image formed on the surface of the electrophotographic photosensitive member with a toner to form a toner image on the surface of the electrophotographic photosensitive member, wherein the developing unit includes a toner; and the charging unit includes a conductive member disposed to be contactable with the electrophotographic photosensitive member.

The toner and the conductive member that have been described above can be used in this process cartridge.

The process cartridge may include a frame in order to support the charging unit and the developing unit.

Figure 4:
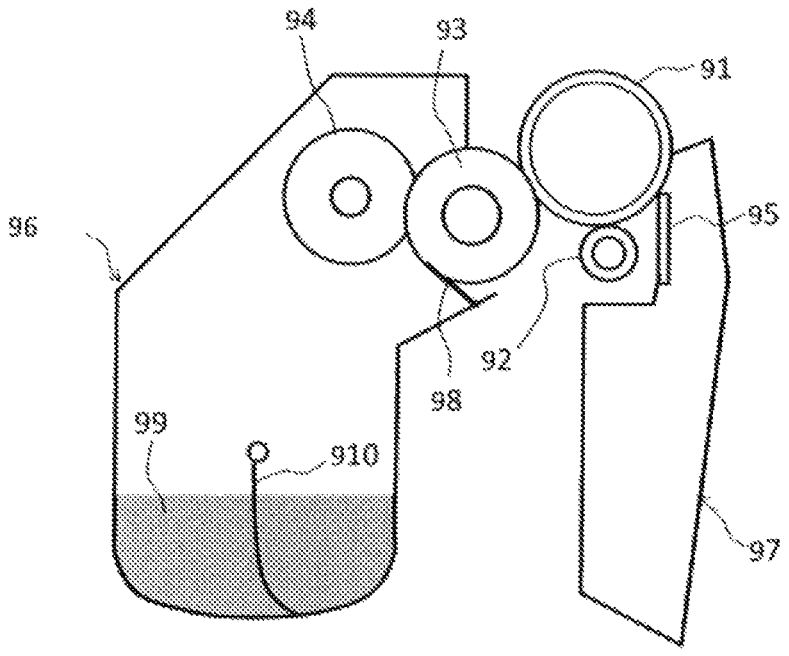
FIG. 4 is a schematic diagram of a process cartridge.

FIG. 4 is a schematic cross-sectional diagram of an electrophotographic process cartridge equipped with a conductive member as a charging roller. This process cartridge includes a developing unit and charging unit formed into a single article and is configured to be detachable from and attachable to the main body of an electrophotographic apparatus.

The developing unit is provided with at least a developing roller 93, and includes a toner 99. The developing unit may optionally include a toner supply roller 94, a toner container 96, a developing blade 98, and a stirring blade 910 formed into a single article.

The charging unit should be provided with at least a charging roller 92 and may be provided with a cleaning blade 95 and a waste toner container 97. The conductive member should be disposed to be contactable with the electrophotographic photosensitive member, and due to this the electrophotographic photosensitive member (photosensitive drum 91) may be integrated with the charging unit as a constituent element of the process cartridge or may be fixed in the main body as a constituent element of the electrophotographic apparatus.

A voltage may be applied to each of the charging roller 92, developing roller 93, toner supply roller 94, and developing blade 98.

The Electrophotographic Apparatus

The electrophotographic apparatus has the following features.

An electrophotographic apparatus including an electrophotographic photosensitive member, a charging unit for charging a surface of the electrophotographic photosensitive member, and a developing unit for forming a toner image on the surface of the electrophotographic photosensitive member by developing an electrostatic latent image formed on the surface of the electrophotographic photosensitive member with a toner, wherein the charging unit includes a conductive member disposed to be contactable with the electrophotographic photosensitive member.

The toner and the conductive member that have been described above can be used in this electrophotographic apparatus.

The electrophotographic apparatus may include an image-wise exposure unit for irradiating the surface of the electrophotographic photosensitive member with image-wise exposure light to form an electrostatic latent image on the electrophotographic photosensitive member;

a transfer unit for transferring a toner image formed on the surface of the electrophotographic photosensitive member to a recording medium; and a fixing unit for fixing, to the recording medium, the toner that has been transferred to the recording medium.

Figure 5:
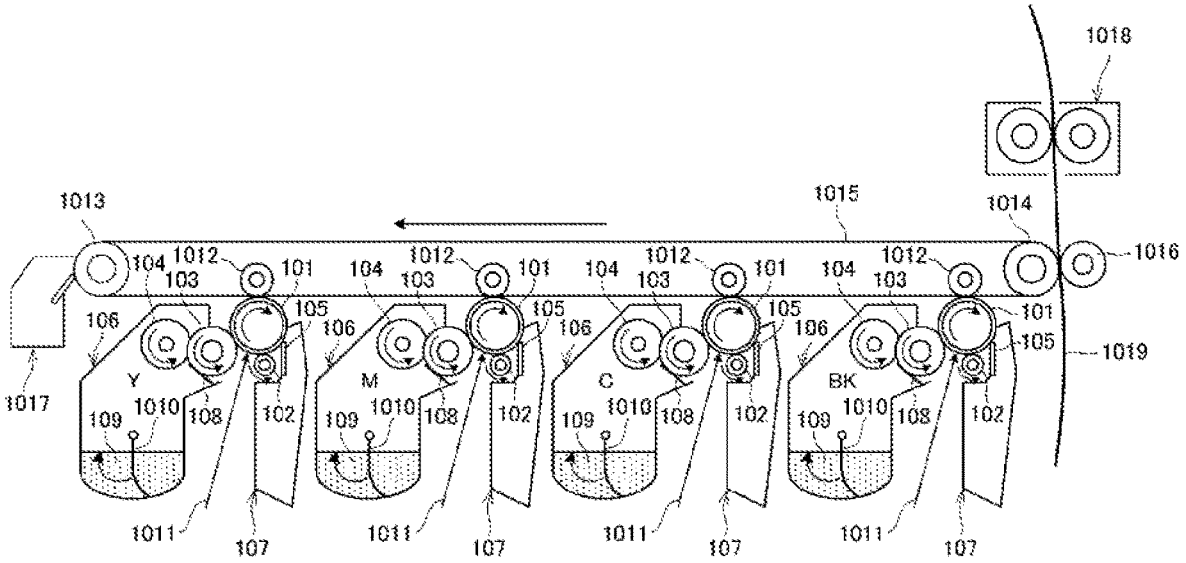
FIG. 5 is a schematic cross-sectional diagram of an electrophotographic apparatus.

FIG. 5 is a schematic component diagram of an electrophotographic apparatus that uses a conductive member as a charging roller. This electrophotographic apparatus is a color electrophotographic apparatus in which four process cartridges are detachably mounted. Toners in each of the following colors are used in the respective process cartridges: black, magenta, yellow, and cyan.

A photosensitive drum 101 rotates in the direction of the arrow and is uniformly charged by a charging roller 102, to which a voltage has been applied from a charging bias power source, and an electrostatic latent image is formed on the surface of the photosensitive drum 101 by exposure light 1011. On the other hand, a toner 109, which is stored in a toner container 106, is supplied by a stirring blade 1010 to a toner supply roller 104 and is transported onto a developing roller 103.

The toner 109 is uniformly coated onto the surface of the developing roller 103 by a developing blade 108 disposed in contact with the developing roller 103, and in combination with this charge is imparted to the toner 109 by triboelectric charging. The electrostatic latent image is visualized as a toner image by development by the application of the toner 109 transported by the developing roller 103 disposed in contact with the photosensitive drum 101.

The visualized toner image on the photosensitive drum is transferred, by a primary transfer roller 1012 to which a voltage has been applied from a primary transfer bias power source, to an intermediate transfer belt 1015, which is supported and driven by a tension roller 1013 and an intermediate transfer belt driver roller 1014. The toner image for each color is sequentially stacked to form a color image on the intermediate transfer belt.

A transfer material 1019 is fed into the apparatus by a paper feed roller and is transported to between the intermediate transfer belt 1015 and a secondary transfer roller 1016. Under the application of a voltage from a secondary transfer bias power source, the secondary transfer roller 1016 transfers the color image on the intermediate transfer belt 1015 to the transfer material 1019. The transfer material 1019 to which the color image has been transferred is subjected to a fixing process by a fixing unit 1018 and is discharged from the apparatus to complete the printing operation.

Otherwise, the untransferred toner remaining on the photosensitive drum is scraped off by a cleaning blade 105 and is held in a waste toner collection container 107, and the cleaned photosensitive drum 101 repeats the aforementioned process. In addition, untransferred toner remaining on the primary transfer belt is also scraped off by a cleaning unit 1017.

The Cartridge Set

The cartridge set has the following features.

A cartridge set including a first cartridge and a second cartridge detachably provided to a main body of an electrophotographic apparatus, wherein the first cartridge includes a charging unit for charging a surface of an electrophotographic photosensitive member and a first frame for supporting the charging unit;

the second cartridge includes a toner container that holds a toner for forming a toner image on the surface of the electrophotographic photosensitive member by developing an electrostatic latent image formed on the surface of the electrophotographic photosensitive member; and the charging unit includes a conductive member disposed to be contactable with the electrophotographic photosensitive member.

The toner and the conductive member that have been described above can be used in this cartridge set.

Since the conductive member should be disposed to be contactable with the electrophotographic photosensitive member, the first cartridge may be provided with the electrophotographic photosensitive member or the electrophotographic photosensitive member may be fixed in the main body of the electrophotographic apparatus. For example, the first cartridge may have an electrophotographic photosensitive member, a charging unit for charging the surface of the electrophotographic photosensitive member, and a first frame for supporting the electrophotographic photosensitive member and the charging unit. However, the second cartridge may be provided with the electrophotographic photosensitive member.

The first cartridge or the second cartridge may be provided with a developing unit for forming a toner image on the surface of the electrophotographic photosensitive member. The developing unit may be fixed in the main body of the electrophotographic apparatus.

Image-Forming Method

The image-forming method is configured as follows.

The image-forming method forms an image using an electrophotographic apparatus that has an electrophotographic photosensitive member, a charging unit for charging a surface of the electrophotographic photosensitive member, and a developing unit for forming a toner image on the surface of the electrophotographic photosensitive member by developing with a toner an electrostatic latent image formed on the surface of the electrophotographic photosensitive member, wherein the charging unit has a conductive member disposed to be contactable with the electrophotographic photosensitive member.

The toner and conductive member that have been described above can be used in this image-forming method.

The electrophotographic apparatus may have an image-wise exposure unit that irradiates image-wise exposure light onto the surface of the electrophotographic photosensitive member to form an electrostatic latent image on the surface of this electrophotographic photosensitive member;

a transfer unit that transfers a toner image formed on the surface of the electrophotographic photosensitive member to a recording medium; and a fixing unit for fixing, to the recording medium, the toner image that has been transferred to the recording medium.

Measurement Methods for Various Properties

The methods used to measure the various properties are as follows.

Method for Measuring Powder Dynamic Viscoelasticity of Toner

The measurement is carried out using a DMA 8000 (PerkinElmer Inc.) dynamic viscoelastic measurement instrument.

measurement tool: Material Pocket (P/N: N533-0322)

80 mg of the toner is sandwiched in the Material Pocket; this is installed in the single cantilever; and attachment is carried out by tightening the screw with a torque wrench.

Figure 7:
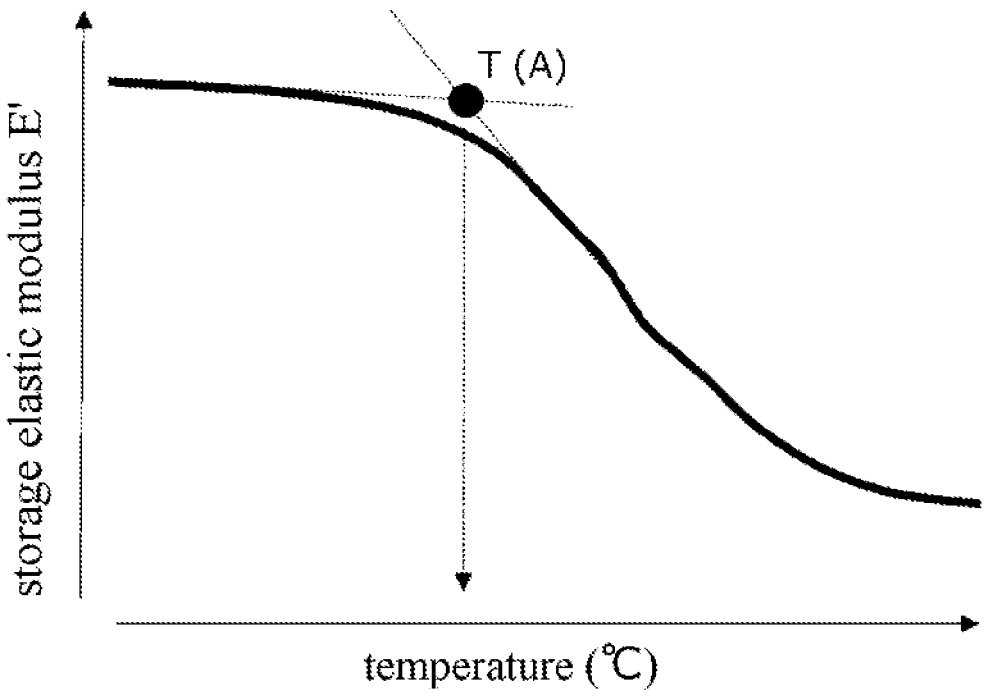
FIG. 7 is an example of an onset temperature T(A).

The "DMA Control Software" (PerkinElmer Inc.) dedicated software is used for the measurement. The measurement conditions are as follows.

oven: Standard Air Oven
measurement type: temperature scan
DMA condition: single frequency/strain (G)
frequency: 1 Hz
strain: 0.05 mm
start temperature: 25° C.
end temperature: 180° C.
scan rate: 20° C./min
deformation mode: single cantilever (B)
cross section: rectangle (R)
test specimen size (length): 17.5 mm
test specimen size (width): 7.5 mm
test specimen size (thickness): 1.5 mm The onset temperature T(A) is determined from the curve yielded by this measurement for the storage elastic modulus E'. T(A) is the temperature corresponding to the intersection between the straight line provided by extending the baseline on the low-temperature side of the E' curve to the high-temperature side, and the tangent drawn at the point at which the slope of the E' curve assumes a maximum (FIG. 7).

Measurement of Maximum Endothermic Peak of Toner

The maximum endothermic peak of the toner is measured using DSC. The measurement is performed in accordance with ASTM D 3417-99. The following, for example, can be used for this measurement: DSC-7 from PerkinElmer Inc., DSC2920 from TA Instruments, Inc., and Q1000 from TA Instruments, Inc.

The melting points of indium and zinc are used for temperature correction in the instrument detection section, and the heat of fusion of indium is used for correction of the amount of heat. The measurement is run using an aluminum pan for the measurement sample and installing an empty pan for reference.

Isolation of Crystalline Material (Measurement of Number of Moles of Ester Groups and Molecular Weight)

An isolation procedure is carried out as follows when the raw material for the crystalline material cannot be acquired. Using the obtained crystalline material, the number of moles of ester groups and the molecular weight can be measured using known methods.

First, the toner is dispersed in ethanol, which is a poor solvent for the toner, and heating is carried out to a temperature that exceeds the melting point of the crystalline material. Pressure may be applied at this point as necessary. The crystalline material above the melting point melts at this point. A mixture containing the crystalline material can then be recovered from the toner by solid-liquid separation. The crystalline material can be isolated by fractionating this mixture into individual molecular weights.

Method for Measuring Molecular Weight of Crystalline Polyester

The molecular weight distribution of the crystalline polyester is measured using gel permeation chromatography (GPC) as follows.

First, the crystalline polyester is dissolved in tetrahydrofuran (THF) at room temperature. The obtained solution is filtered using a "Sample Pretreatment Cartridge" (Tosoh Corporation) solvent-resistant membrane filter having a pore diameter of 0.2 μm to obtain a sample solution. The sample solution is adjusted to a concentration of THF-soluble component of 0.8 mass %. Measurement is carried out under the following conditions using this sample solution.

instrument: "HLC-8220GPC" high-performance GPC instrument [Tosoh Corporation]
column: 2×LF-604
eluent: THF
flow rate: 0.6 mL/min
oven temperature: 40° C.
sample injection amount: 0.020 mL A molecular weight calibration curve constructed using polystyrene resin standards (for example, product name "TSK Standard Polystyrene F-850, F-450, F-288, F-128, F-80, F-40, F-20, F-10, F-4, F-2, F-1, A-5000, A-2500, A-1000, A-500", Tosoh Corporation) is used to determine the molecular weight of the sample.

Method for Measuring Weight-Average Particle Diameter (D4) and Number-Average Particle Diameter (D1) of Toner The weight-average particle diameter (D4) and number average particle diameter (D1) of the toner is calculated as follows. A "Multisizer 3 Coulter Counter" precise particle size distribution analyzer (registered trademark, Beckman Coulter, Inc.) based on the pore electrical resistance method and equipped with a 100 μm aperture tube is used as the measurement unit together with the accessory dedicated "Beckman Coulter Multisizer 3 Version 3.51" software (Beckman Coulter, Inc.) for setting the measurement conditions and analyzing the measurement data. Measurement is performed with 25,000 effective measurement channels.

The aqueous electrolytic solution used in measurement may be a solution of special grade sodium chloride dissolved in ion-exchanged water to a concentration of 1 mass %, such as "ISOTON II" (Beckman Coulter, Inc.) for example.

The following settings are performed on the dedicated software prior to measurement and analysis.

On the "Change standard measurement method (SOM)" screen of the dedicated software, the total count number in control mode is set to 50,000 particles, the number of measurements to 1, and the Kd value to a value obtained with "Standard particles 10.0 μm" (Beckman Coulter, Inc.). The threshold and noise level are set automatically by pushing the "Threshold/noise level measurement" button. The current is set to 1600 μA, the gain to 2, and the electrolytic solution to ISOTON II, and a check is entered for "Aperture tube flush after measurement".

On the "Conversion settings from pulse to particle diameter" screen of the dedicated software, the bin interval is set to the logarithmic particle diameter, the particle diameter bins to 256, and the particle diameter range to 2 μm to 60 μm.

The specific measurement methods are as follows.

(1) 200 mL of the aqueous electrolytic solution is placed in a glass 250 mL round-bottomed beaker dedicated to the Multisizer 3, the beaker is set on the sample stand, and stirring is performed with a stirrer rod counter-clockwise at a rate of 24 rps. Contamination and bubbles in the aperture tube are then removed by the "Aperture tube flush" function of the dedicated software.

(2) 30 mL of the same aqueous electrolytic solution is placed in a glass 100 mL flat-bottomed beaker, and 0.3 mL of a dilution of "Contaminon N" (a 10 mass % aqueous solution of a pH 7 neutral detergent for washing precision instruments, comprising a nonionic surfactant, an anionic surfactant, and an organic builder, manufactured by Wako Pure Chemical Industries, Ltd.) diluted three times by mass with ion-exchange water is added.

(3) An ultrasonic disperser "Ultrasonic Dispersion System Tetra150" (Nikkaki Bios Co., Ltd.) with an electrical output of 120 W equipped with two built-in oscillators having an oscillating frequency of 50 kHz with their phases shifted by 180° from each other is prepared. A specified quantity of ion-exchange water is added to the water tank of the ultrasonic disperser, and 2 mL of Contaminon N is added to the tank.

(4) The beaker of (2) above is set in the beaker-fixing hole of the ultrasonic disperser, and the ultrasonic disperser is operated. The height position of the beaker is adjusted so as to maximize the resonant condition of the liquid surface of the aqueous electrolytic solution in the beaker.

(5) The aqueous electrolytic solution in the beaker of (4) above is exposed to ultrasound as 10 mg of toner (particle) is added bit by bit to the aqueous electrolytic solution, and dispersed. Ultrasound dispersion is then continued for a further 60 seconds. During ultrasound dispersion, the water temperature in the tank is adjusted appropriately to from 10° C. to 40° C.

(6) The aqueous electrolytic solution of (5) above with the toner (particle) dispersed therein is dripped with a pipette into the round-bottomed beaker of (1) above set on the sample stand, and adjusted to a measurement concentration of 5%. Measurement is then performed until the number of measured particles reaches 50000.

(7) The measurement data is analyzed with the dedicated software included with the apparatus, and the weight-average particle diameter (D4) and number average particle diameter (D1) are calculated. The weight-average particle diameter (D4) is the "Average diameter" on the "Analysis/volume statistical value (arithmetic mean)" screen when graph/volume % is set in the dedicated software. The Number Average Particle Diameter (D1) is the "Average diameter" on the "Analysis/number statistic value (arithmetic mean)" screen when graph/number % is set in the dedicated software.

Measurement of Relative Permittivity εr of Toner

Preparation of Toner Pellet

The toner is placed in a 25 mm-diameter tool for pellet preparation, and a pellet having a thickness of approximately 1.5 mm is then prepared by the application of pressure for one minute using a Newton press and a pressure condition of 20 MPa. The weighed out amount of the toner is adjusted to provide a pellet thickness of from 1.5 mm to 1.8 mm. The resulting pellet is held for at least 24 hours in a normal-temperature, normal-humidity (temperature=23° C., relative humidity=50% RH) environment to yield the measurement sample. The average value of the pellet thickness measured at 10 points with calipers is used as the sample thickness.

Measurement of Relative Permittivity εr

The measurement is run using a Model 1260 frequency response analyzer (Solartron), a Model 1296 dielectric constant measurement interface (Solartron), and a Model 12962 sample holder for dielectric constant measurements (Solartron).

The fabricated toner pellet is placed in the sample holder and an AC voltage is applied and the impedance is measured. The AC voltage application condition is 0.1 V pp, and the set frequency is 1 Hz to 1 MHz.

Analysis is carried out using ZView impedance analysis software (ZPlot and ZView for Windows from Scribner Associates). The dielectric loss tangent tan δ and relative permittivity εr are calculated as follows from the values of Z' and Z" obtained from the analysis. The values for the dielectric loss tangent tan δ and relative permittivity εr in both instances are the values when the measurement frequency is $1.0\times10^3$ Hz.

$$\tan\delta = Z'/Z'' \quad \text{formula (1)}$$

$$\varepsilon r = \varepsilon/\varepsilon_0 \quad \text{formula (2)}$$

(In formula (2), ε is the permittivity determined according to formula (3) and $\varepsilon_0$ is the vacuum permittivity ($=8.85\times10^{-12}$ F/m).)

$$\varepsilon = \{Z''/(-\omega\times(Z'^2+Z''^2))\}\times D/S \quad \text{formula (3)}$$

(In formula (3), ω is determined by formula (4), D is the thickness of the fabricated toner pellet, and S is the electrode area of the sample holder.)

$$\omega = 2\times\pi\times f \quad \text{formula (4)}$$

(In formula (4), f is the measurement frequency.)

EXAMPLES

The constitution according to the present disclosure is described in greater detail through the examples and comparative examples provided below; however, the constitution according to the present disclosure is not limited to the constitutions that are specifically realized in the examples. In addition, the "parts" used in the examples and comparative examples are on a mass basis unless specifically indicated otherwise.

Conductive Member 101 Production Example

[1-1. Preparation of Domain-Forming Rubber Mixture (CMB)]

A CMB was obtained by mixing the materials indicated in Table 1 at the amounts of incorporation given in Table 1, using a 6-liter pressure kneader (product name: TD6-15MDX, Toshin Co., Ltd.). The mixing conditions were a fill ratio of 70 volume %, a blade rotation rate of 30 rpm, and 30 minutes.

TABLE 1

| | Ingredient name | Amount of incorporation (parts) |
|---|---|---|
| Starting rubber | Styrene-butadiene rubber (product name: TUFDENE 1000, Asahi Kasei Corporation) | 100 |
| Electronic conducting agent | Carbon black (product name: TOKABLACK #5500, Tokai Carbon Co., Ltd.) | 60 |
| Vulcanization co-accelerator | Zinc oxide (product name: Zinc White, Sakai Chemical Industry Co., Ltd.) | 5 |
| Processing aid | Zinc stearate (product name: SZ-2000, Sakai Chemical Industry Co., Ltd.) | 2 |

1-2. Preparation of Matrix-Forming Rubber Mixture (MRC)

An MRC was obtained by mixing the materials indicated in Table 2 at the amounts of incorporation given in Table 2, using a 6-liter pressure kneader (product name: TD6-15MDX, Toshin Co., Ltd.). The mixing conditions were a fill ratio of 70 volume %, a blade rotation rate of 30 rpm, and 16 minutes.

TABLE 2

| | Ingredient name | Amount of incorporation (parts) |
|---|---|---|
| Starting rubber | Butyl rubber (product name: JSR Butyl 065, JSR Corporation) | 100 |
| Filler | Calcium carbonate (product name: NANOX #30, Maruo Calcium Co., Ltd.) | 70 |
| Vulcanization co-accelerator | Zinc oxide (product name: Zinc White, Sakai Chemical Industry Co., Ltd.) | 7 |
| Processing aid | Zinc stearate (product name: SZ-2000, Sakai Chemical Industry Co., Ltd.) | 2.8 |

1-3. Preparation of Unvulcanized Rubber Mixture for Conductive Layer Formation

The CMB and the MRC obtained as described above were mixed at the amounts of incorporation given in Table 3 using a 6-liter pressure kneader (product name: TD6-15MDX, Toshin Co., Ltd.). The mixing conditions were a fill ratio of 70 volume %, a blade rotation rate of 30 rpm, and 20 minutes.

TABLE 3

| | Ingredient name | Amount of incorporation (parts) |
|---|---|---|
| Starting rubber | Domain-forming rubber mixture | 25 |
| Starting rubber | Matrix-forming rubber mixture | 75 |

The vulcanizing agent and vulcanization accelerator indicated in Table 6 were then added in the amounts of incorporation indicated in Table 4 to 100 parts of the CMB+MRC mixture, and mixing was carried out using an open roll with a 12-inch (0.30 m) roll diameter to prepare a rubber mixture for conductive layer formation.

With regard to the mixing conditions, the front roll rotation rate was 10 rpm, the back roll rotation rate was 8 rpm, the roll gap was 2 mm, and turn buck was performed right and left a total of 20 times; this was followed by 10 thin passes on a roll gap of 0.5 mm.

TABLE 4

| | Ingredient name | Amount of incorporation (parts) |
|---|---|---|
| Vulcanizing agent | Sulfur (product name: SULFAX PMC, Tsurumi Chemical Industry Co., Ltd.) | 3 |
| Vulcanization accelerator | Tetramethylthiuram disulfide (product name: TT, Ouchi Shinko Chemical Industrial Co., Ltd.) | 3 |

2. Production of the Conductive Member 2-1. Preparation of a Support Having a Conductive Outer Surface A round bar having a total length of 252 mm and an outer diameter of 6 mm, and having an electroless nickel plating treatment executed on a stainless steel (SUS) surface, was prepared as the support having a conductive outer surface.

2-2. Molding the Conductive Layer

A die with an inner diameter of 12.5 mm was mounted at the tip of a crosshead extruder having a feed mechanism for the support and a discharge mechanism for the unvulcanized rubber roller, and the temperature of the extruder and crosshead was adjusted to 80° C. and the support transport speed was adjusted to 60 mm/sec. Operating under these conditions, the rubber mixture for conductive layer formation was fed from the extruder and the outer circumference of the support was coated in the crosshead with this rubber mixture for conductive layer formation to yield an unvulcanized rubber roller.

The unvulcanized rubber roller was then introduced into a 160° C. convection vulcanization oven and the rubber mixture for conductive layer formation was vulcanized by heating for 60 minutes to obtain a roller having a conductive layer formed on the outer circumference of the support. 10 mm was then cut off from each of the two ends of the conductive layer to provide a length of 231 mm for the longitudinal direction of the conductive layer portion.

Finally, the surface of the conductive layer was ground using a rotary grinder. This yielded a crowned conductive member 101 having a diameter at the center of 8.5 mm and a diameter of 8.44 mm at each of the positions 90 mm toward each of the ends from the center.

The methods for measuring the properties pertaining to the conductive member are as follows.

Confirmation of a Matrix-Domain Structure

The presence/absence of the formation of a matrix-domain structure in the conductive layer is checked using the following method.

Using a razor, a section (thickness=500 μm) is cut out so as to enable the cross section orthogonal to the longitudinal direction of the conductive layer of the conductive member to be observed. Platinum vapor deposition is then carried out and a cross-sectional image is photographed using a scanning electron microscope (SEM) (product name: S-4800, Hitachi High-Technologies Corporation) and a magnification of 1,000×.

Figure 2:
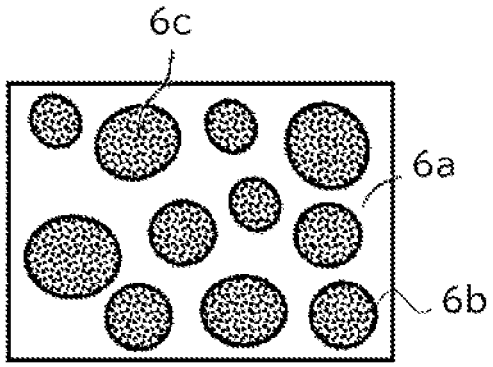
FIG. 2 is an enlarged cross-sectional diagram of a conductive layer.

A matrix-domain structure observed in the section from the conductive layer presents a morphology in which, in the cross-sectional image, a plurality of domains 6*b* are dispersed in a matrix 6*a* and the domains are present in an independent state without connection to each other, as in FIG. 2. 6*c* is an electronic conducting agent. The matrix, on the other hand, resides in a state that is continuous within the image with the domains being partitioned off by the matrix.

In order to quantify the obtained photographed image, a 256-gradation monochrome image is obtained by carrying out 8-bit grey scale conversion using image processing software (product name: Image-Pro Plus, Media Cybernetics, Inc.) on the fracture surface image yielded by the SEM observation. White/black reversal processing is then carried out on the image so the domains in the fracture surface become white, followed by generation of the binarized image with the binarization threshold being set based on the algorithm of Otsu's adaptive thresholding method for the brightness distribution of images.

Using the count function on this binarized image, and operating in a 50 μm-square region, the number percentage K is calculated for the domains that, as noted above, are isolated without connection between domains, with reference to the total number of domains that do not have a contact point with the enclosure lines for the binarized image.

Specifically, the count function of the image processing software is set to not count domains that have a contact point with the enclosure lines for the edges in the four directions of the binarized image.

The arithmetic-mean value (number %) for K is calculated by carrying out this measurement on the aforementioned sections prepared at a total of 20 points, as provided by randomly selecting 1 point from each of the regions obtained by dividing the conductive layer of the conductive member into 5 equal portions in the longitudinal direction and dividing the circumferential direction into 4 equal portions.

A matrix-domain structure is scored as being "present" when the arithmetic-mean value of K (number %) is equal to or greater than 80, and is scored as being "absent" when the arithmetic-mean value of K (number %) is less than 80.

Measurement of the Volume Resistivity R1 of the Matrix

The volume resistivity R1 of the matrix can be measured, for example, by excising, from the conductive layer, a thin section of prescribed thickness (for example, 1 μm) that contains the matrix-domain structure and bringing the microprobe of a scanning probe microscope (SPM) or atomic force microscope (AFM) into contact with the matrix in this thin section.

With regard to the excision of the thin section from the elastic layer, and, for example, as shown in FIG. 3B letting the X axis be the longitudinal direction of the conductive member, the Z axis be the thickness direction of the conductive layer, and the Y axis be its circumferential direction, the thin section is excised so as to contain at least a portion of a plane parallel to the YZ plane (for example, 83*a*, 83*b*, 83*c*), which is orthogonal to the axial direction of the conductive member. Excision can be carried out, for example, using a sharp razor, a microtome, or a focused ion beam technique (FIB).

The volume resistivity is measured by grounding one side of the thin section that has been excised from the conductive layer. The microprobe of a scanning probe microscope (SPM) or atomic force microscope (AFM) is brought into contact with the matrix part on the surface of the side opposite from the ground side of the thin section; a 50 V DC voltage is applied for 5 seconds; the arithmetic-mean value is calculated from the values measured for the ground current value for the 5 seconds; and the electrical resistance value is calculated by dividing the applied voltage by this calculated value. Finally, the resistance value is converted to the volume resistivity using the film thickness of the thin section. The SPM or AFM can also be used to measure the film thickness of the thin section at the same time as measurement of the resistance value.

For a column-shaped charging member, the value of the volume resistivity R1 of the matrix is determined, for example, by excising one thin section sample from each of the regions obtained by dividing the conductive layer into four parts in the circumferential and 5 parts in the longitudinal direction; obtaining the measurement values described above; and calculating the arithmetic-mean value of the volume resistivities for the total of 20 samples.

In the present examples, first a 1 μm-thick thin section was excised from the conductive layer of the conductive member at a slicing temperature of −100° C. using a microtome (product name: Leica EMFCS, Leica Microsystems GmbH). Using the X axis for the longitudinal direction of the conductive member, the Z axis for the thickness direction of the conductive layer, and the Y axis for its circumferential direction, as shown in FIG. 3B, excision was performed such that the thin section contained at least a portion of the YZ plane (for example, 83*a*, 83*b*, 83*c*), which is orthogonal with respect to the axial direction of the conductive member.

Operating in an environment having a temperature of 23° C. and a humidity of 50%, one side of the thin section (also referred to hereafter as the "ground side") was grounded on a metal plate, and the cantilever of a scanning probe microscope (SPM) (product name: Q-Scope 250, Quesant Instrument Corporation) was brought into contact at a location corresponding to the matrix on the side (also referred to hereafter as the "measurement side") opposite from the ground side of the thin section, and where domains were not present between the measurement side and ground side. A voltage of 50 V was then applied to the cantilever for 5 seconds; the current value was measured; and the 5-second arithmetic-mean value was calculated.

The surface profile of the section subjected to measurement was observed with the SPM and the thickness of the measurement location was calculated from the obtained height profile. In addition, the depressed portion area of the cantilever contact region was calculated from the results of observation of the surface profile. The volume resistivity was calculated from this thickness and this depressed portion area.

With regard to the thin sections, the aforementioned measurement was performed on sections prepared at a total of 20 points, as provided by randomly selecting 1 point from each of the regions obtained by dividing the conductive layer of the conductive member into 5 equal portions in the longitudinal direction and dividing the circumferential direction into 4 equal portions. The average value was used as the volume resistivity R1 of the matrix.

The scanning probe microscope (SPM) (product name: Q-Scope 250, Quesant Instrument Corporation) was operated in contact mode.

Measurement of the Volume Resistivity R2 of the Domains

The volume resistivity R2 of the domains is measured by the same method as for measurement of the matrix volume resistivity R1 as described above, but carrying out the measurement at a location corresponding to a domain in the ultrathin section and changing the measurement voltage to 1 V.

In the present examples, R2 was calculated using the same method as above (measurement of the matrix volume resistivity R1), but changing the voltage applied during measurement of the current value to 1 V and changing the location of cantilever contact on the measurement side to a location corresponding to a domain, and where the matrix was not present between the measurement side and ground side.

Measurement of Martens Hardness

The Martens hardness is measured using a microhardness tester (product name: PICODENTER HM500, Helmut Fischer GmbH). The "WIN-HCU" (product name) provided with this surface coating property tester is used as the software. The Martens hardness is a property value determined by pressing an indenter into the measurement target while applying a load, and is given by (test load)/(surface area of indenter under the test load) ($N/mm^2$)

The indenter, e.g., a four-sided pyramid, is pressed into the measurement target while applying a relatively small specified test load; the surface area contacted by the indenter is determined from the indention depth when a prescribed indention depth has been achieved; and the universal hardness is determined using the formula given below. The hardness for indention at a load of 1 mN is used in the present invention.

The measurement is carried out based on ISO 14577 using a surface coating property tester (product name: PICODENTER HM500). Ten locations randomly selected in the central area of the conductive member are used as the measurement points, and the arithmetic average value of the Martens hardness measurements is used as the measurement value for the developer carrying member. The measurement conditions are as follows:

measurement indenter: four-sided pyramid (136° angle, Berkovich type);

indenter material: diamond;

measurement environment: temperature of 23° C., relative humidity of 50%;

loading rate and unloading rate: 1 mN/50 sec;

maximum indention load: 1 mN.

The load-hardness curve is measured by applying the load at the rate given above in the conditions, and the Martens hardness when an indentation depth of 0.1 μm has been reached is calculated using the following formula.

$$\text{Martens hardness HM } (N/mm^2) = F(N)/\text{surface area } (mm^2) \text{ of the indenter under the test load}$$

In the formula, F refers to force and t refers to time.

$$\text{indentation Young's modulus } E \text{ (Pa)} = (1-\nu i^2)/Ei + (1-\nu s^2)/Es$$

Ei is the Young's modulus of the indenter; νi is the Poisson's ratio of the indenter; and νs is the Poisson's ratio of the conductive member.

Measurement of Martens Hardness of Matrix Region and Martens Hardness of Domain Region The Martens hardness of the matrix region and the domain region is specifically measured as follows. First, a measurement sample containing the outer surface of the conductive member is sliced, using a razor, from the conductive member that is the measurement target. The measurement sample is excised so as to have a length of 2 mm in both the circumferential direction and longitudinal direction of the conductive member and to have a thickness of 500 μm in the thickness direction from the outer surface of the conductive member.

The resulting measurement sample is placed in the microhardness tester so as to enable observation of the observation surface of the measurement sample, which corresponds to the outer surface of the conductive member. Observation of the observation surface is carried out with the microscope (50× magnification) attached to the microhardness tester, and 10 points, in each case separated by at least 0.1 μm from any domain margin, are randomly selected from the matrix region. The tip of the measurement indenter is brought into contact with each of these 10 points and the Martens hardness is measured using the conditions given above. The arithmetic average value of the measurement values obtained at the 10 points is used as the Martens hardness G1 of the matrix region.

Operating in the same manner, 10 domains are randomly selected during observation of the observation surface of the measurement sample, and in each case the measurement indenter is brought into contact with the position of the geometric center on the plane of the domain and the Martens hardness is measured using the conditions given above. The arithmetic average value of the resulting 10 measurement values is used as the Martens hardness G2 of the domain region.

The size relationship between the hardness of the domain region and the hardness of the matrix region is evaluated by comparing the thusly obtained values for the Martens hardness of the domain region and the Martens hardness of the matrix region.

Measurement of the Circle-Equivalent Diameter D of Domains Observed from the Cross Section of the Conductive Layer The circle-equivalent diameter D of the domains is determined as follows.

Using L for the length in the longitudinal direction of the conductive layer and T for the thickness of the conductive layer, 1 μm-thick samples, having sides as represented by cross sections in the thickness direction (83*a*, 83*b*, 83*c*) of the conductive layer as shown in FIG. 3B, are sliced using a microtome (product name: Leica EMFCS, Leica Microsystems GmbH) from three locations, i.e., the center in the longitudinal direction of the conductive layer and at L/4 toward the center from either end of the conductive layer.

For each of the obtained three samples, platinum vapor deposition is performed on the cross section of the thickness direction of the conductive layer. Operating on the platinum vapor-deposited surface of each sample, a photograph is taken at 5,000× using a scanning electron microscope (SEM) (product name: S-4800, Hitachi High-Technologies Corporation) at three randomly selected locations within the thickness region that is a depth of 0.1T to 0.9T from the outer surface of the conductive layer.

Using image processing software (product name: Image-Pro Plus, Media Cybernetics, Inc.), each of the obtained nine photographed images is subjected to binarization and quantification using the count function and the arithmetic-mean value S of the area of the domains contained in each of the photographed images is calculated.

The circle-equivalent domain diameter ($=(4S/\pi)^{0.5}$) is then calculated from the calculated arithmetic-mean value S of the domain area for each of the photographed images. The arithmetic-mean value of the circle-equivalent domain diameter for each photographed image is subsequently calculated to obtain the circle-equivalent diameter D of the domains observed from the cross section of the conductive layer of the conductive member that is the measurement target.

Measurement of the Particle Size Distribution of the Domains

In order to evaluate the uniformity of the circle-equivalent diameter D of the domains, the particle size distribution of the domains is measured proceeding as follows. First, binarized images are obtained using image processing software (product name: Image-Pro Plus, Media Cybernetics, Inc.) from the 5000× observed images obtained using a scanning electron microscope (product name: S-4800, Hitachi High-Technologies Corporation) in the above-described measurement of the circle-equivalent diameter D of the domains. Then, using the count function of the image processing software, the average value D and the standard deviation σd are calculated for the domain population in the binarized image, and σd/D, which is a metric of the particle size distribution, is subsequently calculated.

For the measurement of the σd/D particle size distribution of the domain diameters, and using L for the length in the longitudinal direction of the conductive layer and T for the thickness of the conductive layer, cross sections in the thickness direction of the conductive layer, as shown in FIG. 3B, are taken at three locations, i.e., the center in the longitudinal direction of the conductive layer and at L/4 toward the center from either end of the conductive layer. Operating at a total of 9 locations, i.e., 3 randomly selected locations in the thickness region at a depth of 0.1T to 0.9T from the outer surface of the conductive layer, in each of the 3 sections obtained at the aforementioned 3 measurement locations, a 50 μm-square region is extracted as the analysis image; the measurement is performed; and the arithmetic-mean value for the 9 locations is calculated.

Measurement of the Interdomain Distance Dm Observed from the Cross Section of the Conductive Layer Using L for the length in the longitudinal direction of the conductive layer and T for the thickness of the conductive layer, samples, having sides as represented by the cross sections in the thickness direction (83*a*, 83*b*, 83*c*) of the conductive layer as shown in FIG. 3B, are taken from three locations, i.e., the center in the longitudinal direction of the conductive layer and at L/4 toward the center from either end of the conductive layer.

For each of the obtained three samples, a 50 μm-square analysis region is placed, on the surface presenting the cross section in the thickness direction of the conductive layer, at three randomly selected locations in the thickness region from a depth of 0.1T to 0.9T from the outer surface of the conductive layer. These three analysis regions are photographed at a magnification of 5000× using a scanning electron microscope (product name: S-4800, Hitachi High-Technologies Corporation). Each of the obtained total of 9 photographed images is binarized using image processing software (product name: LUZEX, Nireco Corporation).

The binarization procedure is carried out as follows. 8-bit grey scale conversion is performed on the photographed image to obtain a 256-gradation monochrome image. White/black reversal processing is carried out on the image so the domains in the photographed image become white, and binarization is performed to obtain a binarized image of the photographed image. For each of the 9 binarized images, the distances between the domain wall surfaces are then calculated, and the arithmetic-mean value of these is calculated. This is designated Dm. The distance between the wall surfaces is the distance between the wall surfaces of domains that are nearest to each other (shortest distance), and can be determined by setting the measurement parameters in the image processing software to the distance between adjacent wall surfaces.

Measurement of the Uniformity of the Interdomain Distance Dm

The standard deviation om of the interdomain distance is calculated from the distribution of the distance between the domain wall surfaces obtained in the procedure described above for measuring the interdomain distance Dm, and the variation coefficient am/Dm, with is a metric of the uniformity of the interdomain distance, is calculated.

Measurement of Volume Fraction

The volume fraction of the domains is determined by three-dimensional measurement of the conductive layer using FIB-SEM.

Specifically, using an FIB-SEM (FEI Company) (details provided above), cross section exposure by the focused ion beam and SEM observation are carried out repeatedly to acquire a slice image set.

The obtained images are thereafter used for the three-dimensional construction of the matrix-domain structure using Avizo 3D visualization and analysis software (FEI Company). The matrix-domain structure is then differentiated by binarization using this analysis software.

In order to quantify the volume ratio, the volume of the domains contained in one cube-shaped sample with a 10-μm edge randomly selected from within the three-dimensional image is calculated.

Using L for the length in the longitudinal direction of the conductive layer and T for the thickness of the conductive layer, this measurement of the domain volume fraction is carried out by acquiring cross sections in the thickness direction of the conductive layer as shown in FIG. 3B, at three locations, i.e., the center in the longitudinal direction of the conductive layer and at L/4 toward the center from either end of the conductive layer. The measurement is carried out by extracting a cube shape with a 10-μm edge as the sample at three randomly selected locations in the thickness region from a thickness of 0.1T to 0.9T from the outer surface of the conductive layer, for each of the three slices obtained at the indicated three measurement locations, i.e., at a total of nine locations; the arithmetic average value for the nine locations is calculated.

TABLE 5A-1

| | Conductive support | | Domain-forming rubber mixture | | | | | | | |
|---|---|---|---|---|---|---|---|---|---|---|
| | | | Rubber starting material | | | | Conductive agent | | | Dispersing time | |
| Conductive member No. | Type | Conductive surface | Material abbreviation | | SP value | Mooney viscosity | Type | Parts | DBP | min | Mooney viscosity |
| 101 | SUS | Ni plating | SBR | T1000 | 16.8 | 45 | #5500 | 60 | 155 | 30 | 84 |
| 102 | SUS | Ni plating | Butyl | JSR Butyl 065 | 15.8 | 32 | #5500 | 80 | 155 | 30 | 75 |
| 103 | SUS | Ni plating | Butyl | JSR Butyl 065 | 15.8 | 32 | #7360 | 45 | 87 | 30 | 65 |
| 104 | SUS | Ni plating | Butyl | JSR Butyl 065 | 15.8 | 32 | #7360 | 42 | 87 | 40 | 60 |
| 105 | SUS | Ni plating | NBR | DN401LL | 17.4 | 32 | #7360 | 60 | 87 | 30 | 51 |
| 106 | SUS | Ni plating | NBR | N202S | 20.4 | 51 | #5500 | 80 | 155 | 30 | 105 |
| 107 | SUS | Ni plating | Butyl | JSR Butyl 065 | 15.8 | 32 | #5500 | 90 | 155 | 30 | 90 |
| 108 | SUS | Ni plating | SBR | T2100 | 17.0 | 78 | #5500 | 80 | 155 | 30 | 105 |
| 109 | SUS | Ni plating | NBR | N202S | 20.4 | 57 | #7360 | 60 | 87 | 30 | 85 |
| 201 | SUS | Ni plating | NBR | N230SV | 19.2 | 32 | LV | 3 | — | 30 | 35 |
| 202 | SUS | Ni plating | BR | JSR T0700 | 17.1 | 43 | #7360 | 80 | 87 | 30 | 85 |
| 203 | SUS | Ni plating | SBR | T2003 | 17.0 | 45 | — | — | — | — | 45 |
| 204 | SUS | Ni plating | SBR | T1000 | 16.8 | 45 | #5500 | 60 | 155 | 30 | 75 |
| 205 | SUS | Ni plating | Butyl | JSR Butyl 065 | 15.8 | 32 | Ketjen | 12 | 360 | 30 | 50 |

With regard to the Mooney viscosity in the table, the values for the starting rubbers are the catalogue values provided by the particular manufacturer. The Mooney viscosity values for the mixtures are the Mooney viscosity ML(1+4) based on JIS K 6300-1: 2013 and were measured at the rubber temperature when all the materials constituting the mixture were being kneaded. The unit for the SP value is $(J/cm^3)^{0.5}$, and DBP represents the DBP oil absorption ($cm^3$/100 g). The individual materials are given in Tables 5B-1 to 5B-3.

TABLE 5A-2

| Conductive member No. | Matrix-forming rubber mixture: Starting material rubber: Material abbreviation | | SP value | Mooney viscosity | Conductive agent: Type | Conductive agent: Parts | Mooney viscosity | Unvulcanized rubber composition: Domain Parts |
|---|---|---|---|---|---|---|---|---|
| 101 | Butyl | JSR Butyl 065 | 15.8 | 32 | — | — | 40 | 25 |
| 102 | SBR | A303 | 17.0 | 46 | — | — | 75 | 22 |
| 103 | SBR | A303 | 17.0 | 46 | — | — | 75 | 15 |
| 104 | SBR | A303 | 17.0 | 46 | — | — | 75 | 15 |
| 105 | Butyl | JSR Butyl 065 | 15.8 | 32 | — | — | 40 | 15 |
| 106 | SBR | A303 | 17.0 | 46 | — | — | 78 | 15 |
| 107 | EPDM | Esplene301A | 17.0 | 44 | — | — | 90 | 22 |
| 108 | EPDM | Esplene301A | 17.0 | 44 | — | — | 58 | 15 |
| 109 | EPDM | Esplene505A | 16.0 | 47 | — | — | 52 | 25 |
| 201 | — | — | — | — | — | — | — | 100 |
| 202 | NBR | N230SV | 19.2 | 32 | — | — | 37 | 25 |
| 203 | NBR | N230SV | 19.2 | 32 | #7360 | 60 | 74 | 75 |
| 204 | NBR | N260S | 17.2 | 46 | — | — | 51 | 25 |
| 205 | EPDM | Esplene301A | 17.0 | 44 | — | — | 90 | 22 |

| Conductive member No. | Unvulcanized rubber composition Matrix Parts | Unvulcanized rubber dispersion: Rotation rate rpm | Kneading time min | Vulcanizing agent: Material | Vulcanizing agent: Parts | Vulcanization accelerator: Type | Vulcanization accelerator: Parts |
|---|---|---|---|---|---|---|---|
| 101 | 75 | 30 | 20 | sulfur | 3 | TT | 3 |
| 102 | 78 | 30 | 20 | sulfur | 3 | TT | 2 |
| 103 | 85 | 30 | 20 | sulfur | 3 | TT | 2 |
| 104 | 85 | 30 | 20 | sulfur | 3 | TT | 2 |
| 105 | 85 | 30 | 20 | sulfur | 3 | TT | 3 |
| 106 | 85 | 30 | 20 | sulfur | 7 | TT | 4 |
| 107 | 78 | 30 | 20 | sulfur | 3 | TET | 3 |
| 108 | 85 | 30 | 20 | sulfur | 3 | TET | 3 |
| 109 | 75 | 30 | 20 | sulfur | 3 | TET | 3 |
| 201 | 0 | — | — | sulfur | 3 | TBZTD | 1 |
| 202 | 75 | 30 | 20 | sulfur | 3 | TBZTD | 1 |
| 203 | 25 | 30 | 20 | sulfur | 3 | TBZTD | 1 |
| 204 | 75 | 30 | 20 | sulfur | 3 | TBZTD | 1 |
| 205 | 78 | 30 | 20 | sulfur | 3 | TET | 3 |

The Mooney viscosity values in the table for the rubber starting materials are catalogue values provided by the particular company. The Mooney viscosity values for the matrix-forming rubber mixtures are the Mooney viscosity $ML_{(1+4)}$ based on JIS K 6300-1:2013, and were measured at the rubber temperature when all of the materials constituting the matrix-forming rubber mixture were being kneaded. The unit for the SP value is $(J/cm^3)^{0.5}$.

TABLE 5B-1

| Rubber Materials | | | | |
|---|---|---|---|---|
| Material abbreviation | | Material name | Product name | Manufacturer name |
| Butyl | Butyl065 | butyl rubber | JSR Butyl 065 | JSR Corporation |
| EPDM | Esplene301A | ethylene-propylene-diene rubber | Esprene 301A | Sumitomo Chemical Co., Ltd. |
| EPDM | Esplene505A | ethylene-propylene-diene rubber | Esprene 505A | Sumitomo Chemical Co., Ltd. |
| NBR | DN401LL | acrylonitrile-butadiene rubber | Nipol DN401LL | ZEON Corporation |
| NBR | N230SV | acrylonitrile-butadiene rubber | NBR N230SV | JSR Corporation |
| NBR | N260S | acrylonitrile-butadiene rubber | NBR N260S | JSR Corporation |
| NBR | N202S | acrylonitrile-butadiene rubber | NBR N202S | JSR Corporation |
| SBR | T2003 | styrene-butadiene rubber | TUFDENE 2003 | Asahi Kasei Corporation |
| SBR | T1000 | styrene-butadiene rubber | TUFDENE 1000 | Asahi Kasei Corporation |
| SBR | T2100 | styrene-butadiene rubber | TUFDENE 2100 | Asahi Kasei Corporation |
| SBR | A303 | styrene-butadiene rubber | ASAPREN 303 | Asahi Kasei Corporation |
| BR | JSR T0700 | polybutadiene rubber | JSR T0700 | JSR Corporation |

TABLE 5B-2

| Conductive Agents | | | |
|---|---|---|---|
| Abbreviation for material | Material name | Product name | Manufacturer |
| #7360 | Conductive carbon black | TOKABLACK #7360SB | Tokai Carbon Co., Ltd. |
| #5500 | Conductive carbon black | TOKABLACK #5500 | Tokai Carbon Co., Ltd. |
| KETJEN | Conductive carbon black | Carbon ECP | Lion Specialty Chemicals Co., Ltd. |
| LV | Ionic conducting agent | LV70 | ADEKA |

TABLE 5B-3

| Vulcanizing Agents and Vulcanization Accelerators | | | |
|---|---|---|---|
| Abbreviation for material | Material name | Product name | Manufacturer |
| Sulfur | Sulfur | SULFAX PMC | Tsurumi Chemical Industry Co., Ltd. |
| TT | Tetramethylthiuram disulfide | NOCCELER TT-P | Ouchi Shinko Chemical Industrial Co., Ltd. |
| TBZTD | Tetrabenzylthiuram disulfide | Sanceler TBZTD | Sanshin Chemical Industry Co., Ltd. |
| TET | Tetraethylthiuram disulfide | Sanceler TET-G | Sanshin Chemical Industry Co., Ltd. |

The properties of the obtained conductive members are given in Table 6.

The toner production methods will now be described in detail.

Production of WAX1

100 parts of stearic acid and 10 parts of ethylene glycol were added to a reactor fitted with a nitrogen introduction line, water separation tube, stirrer, and thermocouple and a reaction was run for 15 hours under normal pressure and a nitrogen current at 180° C. while distilling out the water produced by the reaction. The crude esterification product yielded by this reaction was washed with water by adding 20 parts toluene and 4 parts ethanol per 100 parts of the crude esterification product and, after stirring, standing at quiescence for 30 minutes and then removing the aqueous phase (lower layer) that had separated from the ester phase. This water wash was performed four times, until the pH of the aqueous phase had reached 7.

The solvent was then distilled from the water-washed ester phase at 170° C. under a reduced pressure condition of 5 kPa to obtain WAX1. Analysis of the structure of WAX1 showed that the number of carbons a contained by the acid monomer was 18 and the number of carbons b contained by the alcohol monomer was 2.

Production of WAX2

WAX2 was obtained by carrying out the same procedure as in the production of WAX1, but changing the alcohol monomer from ethylene glycol to behenyl alcohol. Analysis of the structure of WAX2 showed that the number of carbons a contained by the acid monomer was 18 and the number of carbons b contained by the alcohol monomer was 22.

Production of WAX3

WAX3 was obtained by carrying out the same procedure as in the production of WAX1, but changing the acid monomer from stearic acid to behenic acid and changing the alcohol monomer from ethylene glycol to behenyl alcohol. Analysis of the structure of WAX3 showed that the number of carbons a contained by the acid monomer was 22 and the number of carbons b contained by the alcohol monomer was 22.

TABLE 6

| | | Evaluation of the characteristics of the matrix-domain structure | | | | | | | | | |
|---|---|---|---|---|---|---|---|---|---|---|---|
| | | Matrix | | Domain | | | | | | Particle | |
| Conductive member No. | MD structure | Volume resistivity R1 Ωcm | G1 N/mm$^2$ | Volume resistivity R2 Ωcm | G2 N/mm$^2$ | Dm μm | R1/R2 (times) — | Circle-equivalent diameter D μm | D volume fraction % | size distribution σd/D — | σm/Dm — |
| 101 | present | 5.83E+16 | 2.1 | 1.66E+01 | 2.5 | 0.22 | 3.5E+15 | 0.20 | 25.1 | 0.25 | 0.24 |
| 102 | present | 2.10E+12 | 3.4 | 3.20E+01 | 4.2 | 0.45 | 6.6E+10 | 2.01 | 21.1 | 0.23 | 0.26 |
| 103 | present | 2.10E+12 | 3.2 | 2.60E+05 | 4.2 | 0.44 | 8.1E+06 | 1.98 | 21.2 | 0.22 | 0.25 |
| 104 | present | 2.10E+12 | 3.0 | 2.60E+06 | 4.0 | 0.44 | 8.1E+05 | 1.88 | 20.8 | 0.22 | 0.25 |
| 105 | present | 6.90E+16 | 1.9 | 4.80E+03 | 2.1 | 0.35 | 1.4E+13 | 1.34 | 13.9 | 0.21 | 0.24 |
| 106 | present | 3.50E+15 | 7.2 | 4.10E+01 | 9.9 | 1.24 | 8.5E+13 | 1.21 | 14.5 | 0.26 | 0.37 |
| 107 | present | 6.42E+15 | 2.6 | 5.02E+00 | 3.4 | 1.92 | 1.3E+15 | 1.66 | 20.4 | 0.19 | 0.23 |
| 108 | present | 2.95E+15 | 4.0 | 1.03E+01 | 5.2 | 2.9 | 2.9E+14 | 0.23 | 14.3 | 0.22 | 0.26 |
| 109 | present | 6.27E+15 | 2.6 | 5.76E+01 | 3.1 | 5.6 | 1.1E+14 | 4.93 | 22.6 | 0.22 | 0.2 |
| 201 | absent | — | | — | — | — | — | — | — | — | — |
| 202 | present | 2.60E+09 | 2.1 | 5.20E+01 | 2.5 | 0.23 | 5.0E+07 | 2.30 | 24.3 | 0.25 | 0.26 |
| 203 | present | 9.20E+02 | 11.5 | 2.60E+15 | 4.2 | 2.2 | 3.5E−13 | 2.50 | 75.6 | 0.23 | 0.22 |
| 204 | present | 9.80E+10 | 2.0 | 1.10E+03 | 2.4 | 0.24 | 8.9E+07 | 0.24 | 24.2 | 0.21 | 0.24 |
| 205 | present | 6.42E+15 | 2.6 | 2.10E+02 | 2.1 | 0.84 | 3.1E+13 | 1.24 | 20.9 | 0.25 | 0.23 |

In the table, for example, "5.83E+16" indicates "$5.83 \times 10^{16}$", and "3.5E−13" indicates "$3.5 \times 10^{-13}$". The "MD structure" refers to the presence/absence of a matrix-domain structure. The "circle-equivalent diameter D "is the "circle-equivalent diameter D of the domains", and the "D volume fraction" is the "volume fraction of the domains".

Conductive Members 102 to 109 and 201 to 205 Production Examples

Conductive members 102 to 109 and 201 to 205 were produced proceeding as for conductive member 1, but using the materials and conditions indicated in Table 5A-1 and Table 5A-2 with regard to the starting rubber, conductive agent, vulcanizing agent, and vulcanization accelerator.

The details for the materials indicated in Table 5A-1 and Table 5A-2 are given in Table 5B-1 for the rubber materials, Table 5B-2 for the conductive agents, and Table 5B-3 for the vulcanizing agents and vulcanization accelerators.

WAX4

A paraffin wax (HNP-51, Nippon Seiro Co., Ltd.) was used as a hydrocarbon wax.

Crystalline Polyester 1: Production of CPES1

100.0 parts of sebacic acid as acid monomer 1, 1.6 parts of stearic acid as acid monomer 2, and 89.3 parts of 1,9-nonanediol as the alcohol monomer were introduced into a reactor fitted with a nitrogen introduction line, water separation tube, stirrer, and thermocouple.

The temperature was raised to 140° C. while stirring and a reaction was run for 8 hours while heating to 140° C. under a nitrogen atmosphere and distilling out the water under normal pressure. 0.57 parts of tin dioctylate was then added, after which a reaction was run while raising the temperature to 200° C. at 10° C./hour. The reaction was continued for an additional 2 hours after reaching 200° C.; the pressure in the reactor was then reduced to not more than 5 kPa; and the reaction was run at 200° C. while monitoring the molecular weight to obtain crystalline polyester 1.

Analysis of the obtained crystalline polyester 1 gave a weight-average molecular weight of 38000.

Crystalline Polyester 2: Production of CPES2

Crystalline polyester 2 was obtained by carrying out production using the same steps as in the production of crystalline polyester 1, but changing the alcohol monomer to ethylene glycol and changing the acid monomer to dodecanedioic acid.

Analysis of the obtained crystalline polyester 2 gave a weight-average molecular weight of 42000.

Crystalline Polyester 3: Production of CPES3

Crystalline polyester 3 was obtained by carrying out production using the same steps as in the production of crystalline polyester 2, but adding, at the same time as the other monomers, lauric acid terminal monomer at 20 parts with reference to the total amount of the alcohol monomer and acid monomer.

Analysis of the obtained crystalline polyester 3 gave a weight-average molecular weight of 42000.

Magnetic Iron Oxide Production Example 55 liters of a 4.0 mol/L aqueous sodium hydroxide solution was mixed with stirring into 50 liters of an aqueous ferrous sulfate solution containing $Fe^2$ at 2.0 mol/L to obtain an aqueous ferrous salt solution that contained colloidal ferrous hydroxide. An oxidation reaction was run while holding this aqueous solution at 85° C. and blowing in air at 20 L/min to obtain a slurry that contained core particles.

The obtained slurry was filtered and washed on a filter press, after which the core particles were reslurried by redispersion in water. To this reslurry liquid was added sodium silicate to provide 0.20 mass % as silicon per 100 parts of the core particles; the pH of the slurry was adjusted to 6.0; and magnetic iron oxide particles having a silicon-rich surface were obtained by stirring.

The obtained slurry was filtered and washed with a filter press and was reslurried with deionized water. Into this reslurry liquid (solids fraction=50 g/L) was introduced 500 g (10 mass % relative to the magnetic iron oxide) of the ion-exchange resin SK110 (Mitsubishi Chemical Corporation) and ion-exchange was carried out for 2 hours with stirring. This was followed by removal of the ion-exchange resin by filtration on a mesh; filtration and washing on a filter press; and drying and crushing to obtain a magnetic iron oxide having a number-average particle diameter of 0.23 μm.

Silane Compound Production 30 parts of iso-butyltrimethoxysilane was added dropwise while stirring into 70 parts of deionized water. This aqueous solution was then held at a pH of 5.5 and a temperature of 55° C. and a hydrolysis was run by dispersing for 120 minutes at a peripheral velocity of 0.46 m/s using a disper impeller. The hydrolysis reaction was then stopped by bringing the pH of the aqueous solution to 7.0 and cooling to 10° C. This yielded a silane compound-containing aqueous solution.

Magnetic Body 1 Production 100 parts of the magnetic iron oxide was introduced into a high-speed mixer (Model LFS-2 from Fukae Powtec Corporation) and 8.0 parts of the silane compound-containing aqueous solution was added dropwise over 2 minutes while stirring at a rotation rate of 2000 rpm. This was followed by mixing and stirring for 5 minutes. Then, in order to raise the adherence of the silane compound, drying was carried out for 1 hour at 40° C. and, after the moisture had been reduced, the mixture was dried for 3 hours at 110° C. to develop the condensation reaction of the silane compound. This was followed by crushing and passage through a screen having an aperture of 100 μm to obtain a magnetic body 1.

Amorphous Polyester Resin 1: APES1 Production Example 40 mol % terephthalic acid, 10 mol % trimellitic acid, and 50 mol % bisphenol A/2 mol PO adduct were introduced into a reactor fitted with a nitrogen introduction line, water separation tube, stirrer, and thermocouple, followed by the addition, as catalyst, of 1.5 parts of dibutyltin per 100 parts of the total amount of monomer.

Then, after rapidly heating to 180° C. at normal pressure under a nitrogen atmosphere, a polycondensation was run while distilling off the water while heating from 180° C. to 210° C. at a rate of 10° C./hour. After 210° C. had been reached, the pressure in the reactor was reduced to not more than 5 kPa and a polycondensation was run at 210° C. at a pressure condition of not more than 5 kPa to obtain amorphous polyester resin 1. In this process, the polymerization time was adjusted so the softening point of the obtained polyester resin was 120° C.

Amorphous Polyester Resin 2: APES2 Production Example

| | |
|---|---|
| bisphenol A/ethylene oxide adduct (2.2 mol addition) | 100.0 mol parts |
| terephthalic acid | 60.0 mol parts |
| trimellitic anhydride | 20.0 mol parts |
| acrylic acid | 10.0 mol parts |

A mixture was obtained by combining these polyester monomers and by also adding, so as to provide 5.0 mass % with reference to the polyester resin as a whole, a monohydric saturated secondary aliphatic alcohol (long-chain monomer) having a peak value for the number of carbons of 70. 60 parts of the obtained mixture was introduced into a four-neck flask; a pressure reduction apparatus, water separation apparatus, nitrogen gas introduction apparatus, temperature measurement apparatus, and stirring apparatus were installed; and stirring was performed at 160° C. under a nitrogen atmosphere.

To this was added dropwise, over 4 hours from a dropping funnel, a mixture of 2.0 parts of benzoyl peroxide as a polymerization initiator and 40 parts of a vinyl-polymerizing monomer (styrene: 100.0 mol parts) that will constitute a vinyl polymer segment. A reaction was then run for 5 hours at 160° C.; the temperature was raised to 230° C. and 0.2 mass % dibutyltin oxide was added; and APES 2 was obtained with adjustment of the reaction time to provide a softening point of 130° C.

Amorphous Polyester Resin 3: APES3 Production Example

The starting monomers in the blending amounts (mol parts) given below were introduced into a reactor fitted with a nitrogen introduction line, water separation tube, stirrer, and thermocouple.

| | |
|---|---|
| bisphenol A/propylene oxide adduct (2.0 mol addition): | 44.0 mol parts |
| bisphenol A/ethylene oxide adduct (2.0 mol addition): | 38.0 mol parts |
| ethylene glycol: | 18.0 mol parts |
| terephthalic acid: | 89.0 mol parts |

This was followed by the addition as catalyst of dibutyltin at 1.0 parts per 100 parts of the total amount of starting monomer. The temperature in the reactor was raised to 120° C. while stirring under a nitrogen atmosphere.

A condensation polymerization was subsequently run while stirring and distilling out water while heating at a rate of temperature rise of 10° C./hour from 120° C. to 200° C. After reaching 200° C., the pressure in the reactor was reduced to not more than 5 kPa; a condensation polymerization was run for 3 hours under conditions of 200° C. and not more than 5 kPa; and cooling and pulverization were carried out to produce APES3. APES3 had a softening point of 90.0° C. and a glass transition temperature of 58.5° C.

Toner 1 Production Example

A toner was produced using the following procedure.

An aqueous medium containing a dispersion stabilizer was obtained by introducing 450 parts of a 0.1 mol/L aqueous $Na_3PO_4$ solution into 720 parts of deionized water and heating to 60° C. and then adding 67.7 parts of a 1.0 mol/L aqueous $CaCl_2$) solution.

(Preparation of a Polymerizable Monomer Composition)

| | |
|---|---|
| styrene | 72 parts |
| n-butyl acrylate | 28 parts |
| magnetic body 1 | 65 parts |
| amorphous polyester resin 1 | 4 parts |

These materials were dispersed and mixed to uniformity using an attritor (Mitsui Miike Chemical Engineering Machinery Co., Ltd.) and then heated to 60° C.; to this was added 20 parts of WAX1 as an ester wax with mixing and dissolution to obtain a polymerizable monomer composition.

This polymerizable monomer composition was introduced into the aforementioned aqueous medium, and granulation was carried out by stirring for 10 minutes at 12000 rpm with a T. K. Homomixer (Tokushu Kika Kogyo Co., Ltd.) at 60° C. under an $N_2$ atmosphere. Then, while stirring with a paddle impeller, 8.0 parts of the polymerization initiator t-butyl peroxypivalate was introduced, the temperature was raised to 74° C., and a reaction was run for 3 hours.

After the completion of the reaction, the temperature of the suspension was raised to 100° C. and holding was carried out for 2 hours. This was followed by a cooling step in which water at 0° C. was introduced into the suspension and the suspension was cooled from 98° C. to 30° C. at a rate of 200° C./min; this was followed by holding for 3 hours at 55° C. Cooling was then carried out to 25° C. by spontaneous cooling at room temperature. The cooling rate at this time was 2° C./minute.

Hydrochloric acid was then added to the suspension, which was thoroughly washed to dissolve the dispersion stabilizer, and filtration and drying yielded a toner particle 1 having a weight-average particle diameter of 7.3 μm.

The following materials were admixed using a Henschel mixer (Model FM-10, Mitsui Miike Chemical Engineering Machinery Co., Ltd.) per 100 parts of the obtained toner particle 1 to obtain a toner 1.

hydrophobic silica fine particles having a number-average primary particle diameter of 20 nm, surface-treated with 25 mass % hexamethyldisilazane 0.5 parts hydrophobic silica fine particles having a number-average primary particle diameter of 40 nm, surface-treated with 15 mass % hexamethyldisilazane 0.5 parts The properties of the obtained toner 1 are given in Table 8.

Toners 2 to 5, 10, and 11 Production Example

Toners 2 to 5, 10, and 11 were obtained proceeding as in the Toner 1 Production Example, but using the material constituents shown in Table 7 for the binder resin and crystalline material in the Toner 1 Production Example. The properties of the obtained toners are given in Table 8.

Toner 6 Production Example

The following materials were introduced into an attritor (Mitsui Miike Chemical Engineering Machinery Co., Ltd.), and a pigment masterbatch was prepared by carrying out dispersion for 5 hours at 220 rpm using zirconia particles having a diameter of 1.7 mm.

| | |
|---|---|
| styrene | 60 parts |
| carbon black | 7 parts |

(product name: "Printex 35", Orion Engineered Carbons LLC)

| | |
|---|---|
| charge control agent | 0.10 parts |

(Bontron E-89, Orient Chemical Industries Co., Ltd.)

An aqueous medium containing a dispersion stabilizer was obtained by introducing 450 parts of a 0.1 mol/L aqueous $Na_3PO_4$ solution into 720 parts of deionized water and heating to 60° C. and then adding 67.7 parts of a 1.0 mol/L aqueous $CaCl_2$) solution.

(Preparation of a Polymerizable Monomer Composition)

| | |
|---|---|
| styrene | 12 parts |
| n-butyl acrylate | 28 parts |
| pigment masterbatch | 67.1 parts |
| amorphous polyester resin 1 | 4.0 parts |

These materials were dispersed and mixed to uniformity using an attritor (Mitsui Miike Chemical Engineering Machinery Co., Ltd.) and then heated to 60° C.; to this was added 20 parts of WAX1 as an ester wax with mixing and dissolution to obtain a polymerizable monomer composition.

The ensuing steps were carried out using the same procedures as in the Toner 1 Production Example to obtain toner 6.

Toner 7 Production Example

Toner 7 was obtained proceeding as in the Toner 6 Production Example, but using the material constituents shown in Table 7 for the binder resin and crystalline material in the Toner 6 Production Example. The properties of the obtained toner are given in Table 8.

Toner 8 Production Example

| | |
|---|---|
| amorphous polyester resin 2: | 60.0 parts |
| amorphous polyester resin 3: | 40.0 parts |
| colorant, magnetic body 1: | 60.0 parts |
| crystalline polyester 1: | 4.0 parts |
| release agent, release agent 1: | 2.0 parts |
| (C105, melting point = 105° C., Sasol Limited) | |
| charge control agent T-77 (Hodogaya Chemical Co., Ltd.): | 2.0 parts |

These materials were premixed using an FM mixer (Nippon Coke & Engineering Co., Ltd.); this was followed by melt-kneading using a twin-screw kneading extruder (TEM-26SS, 26 mmφ, L/D=48, Toshiba Machine Co., Ltd.).

The kneading feed rate was 20 kg/h and the rotation rate was 200 rpm, and the die temperature and temperature of the heater for the kneader were adjusted to give a temperature of 150° C. for the resin extruded from the die.

The obtained kneaded material was cooled, coarsely pulverized with a hammer mill, and then pulverized with a mechanical pulverizer (T-250, Turbo Kogyo Co., Ltd.); the resulting finely pulverized powder was classified using a Coanda effect-based multi-grade classifier; and a surface treatment was subsequently performed using a mechanical surface treatment device (Faculty F-400, Hosokawa Micron Corporation).

The surface treatment conditions were as follows: a dispersion rotation rate of 5500 rpm, a classification rotation rate of 7000 rpm, 8 hammers, amount processed per batch=200 g, treatment time=60 sec.

This resulted in a toner particle 8 having a weight-average particle diameter (D4) of 6.8 μm.

Toner 8 was obtained using the same procedure as in the Toner 1 Production Example for the ensuing steps.

Toner 9 Production Example

Toner 9 was obtained proceeding as in the Toner 8 Production Example, but using the material constituents shown in Table 7 for the binder resin and crystalline material in the Toner 8 Production Example. The properties of the obtained toner are given in Table 8.

TABLE 7

| Toner No. | Type of crystalline material | Ester group concentration | Amount of crystalline material (parts) | St/BA | APES1 | APES2 | APES3 |
|---|---|---|---|---|---|---|---|
| 1 | WAX1 | 5.85 | 20 | 72/28 | 4 | — | — |
| 2 | WAX1 | 5.85 | 3 | 76/24 | 4 | — | — |
| 3 | WAX2 | 1.90 | 5 | 76/24 | 4 | — | — |
| 4 | WAX1 | 5.85 | 45 | 72/28 | 4 | — | — |
| 5 | CPES2 | 7.81 | 10 | 68/32 | 4 | — | — |
| 6 | WAX1 | 5.85 | 20 | 72/28 | 4 | — | — |
| 7 | WAX3 | 1.70 | 20 | 72/28 | 4 | — | — |
| 8 | CPES1 | 5.88 | 4 | — | — | 60 | 40 |
| 9 | CPES3 | 8.77 | 10 | — | — | 65 | 45 |
| 10 | WAX4 | 0.00 | 20 | 76/24 | 4 | — | — |
| 11 | CPES3 | 8.77 | 50 | 65/35 | 4 | — | — |

In the table, the unit for the ester group concentration is mmol/g. The amount of APES is given in number of parts. St/BA gives the styrene/n-butyl acrylate mass ratio.

TABLE 8

| Toner No. | T(A) (° C.) | Weight-average particle diameter (μm) | Relative permittivity εr |
|---|---|---|---|
| 1 | 56.5 | 7.3 | 2.35 |
| 2 | 68.0 | 7.4 | 2.37 |
| 3 | 78.5 | 7.2 | 2.38 |
| 4 | 58.0 | 7.1 | 2.34 |
| 5 | 50.0 | 7.3 | 2.33 |
| 6 | 57.5 | 6.9 | 1.71 |
| 7 | 78.0 | 7.1 | 2.01 |
| 8 | 57.0 | 6.8 | 2.42 |
| 9 | 48.0 | 6.9 | 2.41 |
| 10 | 81.0 | 7.5 | 2.44 |
| 11 | 39.0 | 7.3 | 2.38 |

TABLE 9

| Electrophotographic apparatus No. | Conductive member | Toner |
|---|---|---|
| 1 | Conductive member 101 | Toner 1 |
| 2 | Conductive member 102 | Toner 1 |
| 3 | Conductive member 103 | Toner 1 |
| 4 | Conductive member 104 | Toner 1 |
| 5 | Conductive member 105 | Toner 1 |
| 6 | Conductive member 106 | Toner 1 |
| 7 | Conductive member 107 | Toner 1 |
| 8 | Conductive member 108 | Toner 1 |
| 9 | Conductive member 109 | Toner 1 |
| 10 | Conductive member 101 | Toner 2 |
| 11 | Conductive member 101 | Toner 3 |
| 12 | Conductive member 101 | Toner 4 |
| 13 | Conductive member 101 | Toner 5 |
| 14 | Conductive member 101 | Toner 6 |
| 15 | Conductive member 101 | Toner 7 |
| 16 | Conductive member 101 | Toner 8 |
| 17 | Conductive member 101 | Toner 9 |
| 18 | Conductive member 201 | Toner 1 |
| 19 | Conductive member 202 | Toner 1 |
| 20 | Conductive member 203 | Toner 1 |
| 21 | Conductive member 204 | Toner 11 |
| 22 | Conductive member 205 | Toner 10 |

The electrophotographic apparatus was configured using the conductive member+toner combinations given in Table 9.

A detailed explanation follows with regard to the examples and comparative examples.

An HP LaserJet Enterprise Color M553dn was used as the image-forming apparatus. The conductive member and toner in this image-forming apparatus were changed to the combinations shown in Table 9. These printer/process cartridge combinations correspond to the structure shown in FIG. 5.

A modified machine, provided by modifying the printing speed of this image-forming apparatus to 60 prints/minute, was used in the image output evaluations. The results for the examples are given in Table 10, and the results for the comparative examples are given in Table 11.

Evaluation 1 On-Paper Fogging

The evaluation of on-paper fogging was performed in a high-temperature, high-humidity environment (temperature of 30° C., relative humidity of 80%), which is unfavorable for charge rise.

Setting up a long-term durability test, 2 prints/1 job of a horizontal line pattern having a print percentage of 1% was used, and a configuration was used in which the machine was temporarily stopped between jobs, after which the next job was started. An image output test of a total of 50000 prints was run in this mode. Immediately after this, an all-white image was printed on paper to which a sticky note had been attached at the lower center, and the density difference between the region covered by the sticky note and the region not covered by the sticky note was used as the post-durability test fogging.

A reflection densitometer (Reflectometer Model TC-6DS, Tokyo Denshoku Co., Ltd.) was used, and an amber light filter was used for the filter. The values for the post-durability test fogging were evaluated according to the following evaluation criteria.

(Evaluation Criteria)

A: The value is less than 2.0.

B: The value is at least 2.0, but less than 3.0.

C: The value is at least 3.0, but less than 4.0.

D: The value is at least 4.0.

Evaluation 2 Image Density Stability

The image stability was evaluated in a normal-temperature, normal-humidity environment (temperature of 23° C., relative humidity of 50%). A4 color laser copy paper (70 g/m$^2$, Canon, Inc.) was used for the media. An initial solid image density was measured; the solid image density was measured after 50000 prints had been made in intermittent mode of a horizontal line image having a print percentage of 1%; and the difference in these densities was checked. The image density was measured using a MacBeth reflection densitometer (MacBeth Corporation). A smaller density difference indicates a higher image stability.

(Evaluation Criteria)

A: The density difference is less than 0.05.

B: The density difference is at least 0.05, but less than 0.10.

C: The density difference is at least 0.10, but less than 0.15.

D: The density difference is at least 0.15.

Evaluation 3 Image Uniformity (Image Density Uniformity During Durability Testing)

For the image uniformity, a durability test was run using the same environment and conditions as for the image stability in Evaluation 2, and a solid image was printed. A total of five locations, i.e., in the center region, two in the upper region, and two in the lower region, were selected on the solid image after the durability test and the image density was measured. The difference between the maximum value and minimum value of the measured densities was used as a metric of the image uniformity and was evaluated using the following criteria.

(Evaluation Criteria)

A. The density difference is less than 0.05.

B. The density difference is at least 0.05, but less than 0.10.

C. The density difference is at least 0.10, but less than 0.15.

D. The density difference is at least 0.15.

Evaluation 4 Contamination due to Melt Adhesion to Conductive Member (Contamination Streaks)

The evaluation of contamination streaks caused by the melt adhesion of toner to the conductive member was carried out in a normal-temperature, normal-humidity environment (temperature of 23° C., relative humidity of 50%). A4 color laser copy paper (70 g/m$^2$, Canon, Inc.) was used as the media. 50000 prints of a horizontal line image having a print percentage of 1% were made in intermittent mode; this was followed by the execution of an image output test using a solid black image and visual measurement of the number of streaks caused by toner on the conductive member.

(Evaluation Criteria)

A: 0 streaks.

B: 1 to 2 streaks.

C: 3 to 4 streaks.

D: at least 5 streaks.

Evaluation 5 Halftone Rubbing (Low-Temperature Fixability)

The halftone rubbing evaluation was carried out in a low-temperature, low-humidity environment (temperature of 15° C., relative humidity of 10%), which is a demanding environment for the evaluation of low-temperature fixability.

With regard to the evaluation paper, A4 color laser copy paper (70 g/m$^2$, Canon, Inc.) was used as the fixing media. This media is relatively thin and readily provides good results in terms of the low-temperature fixability. On the other hand, toner melting is facilitated, and due to this the occurrence of sticking by the image is facilitated and a rigorous evaluation is thus made possible.

The evaluation procedure was as follows: after the entire fixing unit had been cooled to room temperature, image output was carried out at a set temperature of 170° C. with adjustment of the halftone image density so as to provide an image density from 0.75 to 0.80. The image density was measured using a MacBeth reflection densitometer (MacBeth Corporation).

The fixed image was then rubbed 10 times with lens-cleaning paper under a load of 55 g/cm$^2$ (5.4 kPa). The density reduction percentage at 170° C. was calculated using the following formula and the pre-rubbing image density and the post-rubbing image density.

$$\text{density reduction percentage}(\%)=(\text{pre-rubbing image density}-\text{post-rubbing image density})/\text{pre-rubbing image density}\times 100$$

Operating in the same manner, the density reduction percentage was likewise calculated at 5° C. increments in the fixation temperature up to 210° C.

The relationship between the fixation temperature and the density reduction percentage was obtained by carrying out second-order polynomial approximation using the fixation temperature and the evaluation results for the density reduction percentage obtained from this series of operations. The temperature giving a density reduction percentage of 15% was calculated using this relationship, and this temperature was used as the fixation temperature which represented the threshold at which the low-temperature fixability is excellent. Lower fixation temperatures indicate a better low-temperature fixability.

(Evaluation Criteria)

A. The fixation temperature is less than 190° C.

B. The fixation temperature is at least 190° C., but less than 200° C.

C. The fixation temperature is at least 200° C., but less than 210° C.

D. The fixation temperature is at least 210° C.

Evaluation 6 Toner Storability

The toner was stored in a thermostat for 72 hours at 50° C. and was then filled into a cartridge that had been emptied and a solid image was printed out in the same manner as at the start in Evaluation 2. The difference between the starting density obtained in Evaluation 2 and the image density obtained in Evaluation 6 was measured and evaluated using the following criteria.

A. The density difference is less than 0.05.

B. The density difference is at least 0.05, but less than 0.10.

C. The density difference is at least 0.10.

TABLE 10

| Example | Electrophotographic apparatus No. | Fogging Rank | Fogging Value | Image stability Rank | Image stability Difference | Density uniformity Rank | Density uniformity Difference | Member contamination by melt adhesion Rank | Member contamination by Halftone rubbing Rank | Member contamination by Halftone rubbing Temperature (° C.) | Storability Rank |
|---|---|---|---|---|---|---|---|---|---|---|---|
| 1 | 1 | A | 1.2 | A | 0.03 | A | 0.02 | A | A | 180 | A |
| 2 | 2 | C | 3.6 | C | 0.10 | C | 0.11 | B | A | 180 | A |
| 3 | 3 | B | 2.1 | B | 0.07 | B | 0.08 | B | A | 182 | A |
| 4 | 4 | C | 3.1 | C | 0.11 | C | 0.10 | B | A | 181 | A |
| 5 | 5 | A | 1.5 | A | 0.04 | C | 0.14 | C | A | 179 | A |
| 6 | 6 | B | 2.2 | C | 0.14 | C | 0.12 | A | A | 183 | A |
| 7 | 7 | B | 2.4 | B | 0.07 | B | 0.08 | B | A | 181 | A |
| 8 | 8 | B | 2.9 | B | 0.08 | B | 0.07 | B | A | 178 | A |
| 9 | 9 | C | 3.3 | C | 0.12 | C | 0.11 | C | A | 180 | A |
| 10 | 10 | A | 1.1 | A | 0.04 | A | 0.03 | A | B | 195 | A |
| 11 | 11 | A | 1.6 | B | 0.08 | A | 0.04 | A | C | 203 | A |
| 12 | 12 | A | 1.8 | A | 0.03 | B | 0.07 | B | A | 175 | B |
| 13 | 13 | B | 2.3 | B | 0.07 | B | 0.09 | B | A | 173 | B |
| 14 | 14 | B | 2.6 | B | 0.08 | A | 0.03 | A | A | 188 | A |
| 15 | 15 | B | 2.3 | B | 0.09 | A | 0.02 | A | B | 196 | A |
| 16 | 16 | A | 1.4 | A | 0.02 | A | 0.04 | A | B | 197 | A |
| 17 | 17 | A | 1.7 | A | 0.04 | B | 0.07 | B | A | 170 | B |

TABLE 11

| Comparative example No. | Electrophotographic apparatus No. | Fogging Rank | Fogging Value | Image stability Rank | Image stability Difference | Density uniformity Rank | Density uniformity Difference | Member contamination by melt adhesion Rank | Member contamination by Halftone rubbing Rank | Member contamination by Halftone rubbing Temperature (° C.) | Storability Rank |
|---|---|---|---|---|---|---|---|---|---|---|---|
| 1 | 18 | D | 4.3 | D | 0.18 | D | 0.17 | D | A | 183 | A |
| 2 | 19 | D | 4.5 | D | 0.19 | D | 0.19 | C | A | 179 | A |
| 3 | 20 | D | 4.2 | D | 0.21 | D | 0.18 | D | A | 178 | A |
| 4 | 21 | C | 3.5 | C | 0.12 | D | 0.21 | C | A | 165 | C |
| 5 | 22 | B | 2.2 | B | 0.08 | C | 0.11 | A | D | 215 | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-191593, filed Oct. 18, 2019, which is hereby incorporated by reference herein in its entirety.

What is claimed is:

1. An electrophotographic apparatus, comprising:

an electrophotographic photosensitive member;

a charging unit configured to charge a surface of the electrophotographic photosensitive member, the charging unit comprising a conductive member disposed to be contactable with the electrophotographic photosensitive member; and a developing unit configured to develop an electrostatic latent image formed on the surface of the electrophotographic photosensitive member with a toner to form a toner image on the surface of the electrophotographic photosensitive member, the developing unit containing toner comprising a toner particle that contains a binder resin, a colorant and a crystalline material, wherein the conductive member comprises a support having a conductive outer surface, and a conductive layer disposed on the outer surface of the support, the conductive layer comprises a matrix containing a first rubber, and a plurality of domains dispersed in the matrix, each of the domains contains a second rubber and an electronic conductive agent, at least a portion of the domains being exposed at the outer surface of the conductive member, the outer surface of the conductive member comprises the matrix and the domains exposed therein, the matrix has a volume resistivity R1 of at least $2.00\times10^{12}$ Ω·cm, the domains have a volume resistivity R2 that is smaller than R1, G1<G2, and G1 and G2 are both within 1.0 to 10.0 $N/mm^2$ where G1 is Martens hardness measured on the matrix that is exposed at the outer surface of the conductive member, and G2 is Martens hardness measured on the domains that are exposed at the outer surface of the conductive member, and T(A) is not more than 80.0° C. where T(A) is an onset temperature of the storage elastic modulus E' of the toner according to powder dynamic viscoelastic measurement.

2. The electrophotographic apparatus according to claim 1, wherein R1 is at least $1.0\times10^5$ times R2.

3. The electrophotographic apparatus according to claim 1, wherein an arithmetic average value Dm of distances between adjacent walls of the domains in the conductive layer is 0.15 to 2.00 μm observed in a cross section of the conductive member.

4. The electrophotographic apparatus according to claim 1, wherein T(A) is at least 45.0° C.

5. The electrophotographic apparatus according to claim 1, wherein the crystalline material is present at 1 to 60 mass parts per 100 mass parts of the binder resin.

6. The electrophotographic apparatus according to claim 1, wherein an ester group concentration in the crystalline material is 2.00 to 10.00 mmol/g defined by

[number of moles of ester groups in the crystalline material]/[molecular weight of the crystalline material].

7. The electrophotographic apparatus according to claim 1, wherein the toner has a relative permittivity εr of at least 2.00.

8. The electrophotographic apparatus according to claim 1, wherein the first rubber is at least one member selected from the group consisting of butyl rubber, styrene-butadiene rubber and ethylene-propylene-diene rubber, and the second rubber is at least one member selected from the group consisting of styrene-butadiene rubber, butyl rubber and acrylonitrile-butadiene rubber.

9. The electrophotographic apparatus according to claim 1, wherein the crystalline material comprises at least one member selected from the group consisting of an ester wax and a crystalline polyester.

10. A process cartridge disposed detachably to a main body of an electrophotographic apparatus, the process cartridge comprising:

a charging unit configured to charge a surface of an electrophotographic photosensitive member, the charging unit comprising a conductive member disposed to be contactable with the electrophotographic photosensitive member; and a developing unit configured to develop an electrostatic latent image formed on the surface of the electrophotographic photosensitive member with a toner to form a toner image on the surface of the electrophotographic photosensitive member, the developing unit containing toner comprising a toner particle that contains a binder resin, a colorant and a crystalline material, wherein the conductive member comprises a support having a conductive outer surface, and a conductive layer disposed on the outer surface of the support, the conductive layer comprises a matrix containing a first rubber, and a plurality of domains dispersed in the matrix, each of the domains contains a second rubber and an electronic conductive agent, at least a portion of the domains being exposed at the outer surface of the conductive member, the outer surface of the conductive member comprises the matrix and the domains exposed therein, the matrix has a volume resistivity R1 of at least $2.00\times10^{12}$ Ω·cm, the domains have a volume resistivity R2 that is smaller than R1, G1<G2, and G1 and G2 are both within 1.0 to 10.0 $N/mm^2$ where G1 is Martens hardness measured on the matrix that is exposed at the outer surface of the conductive member, and G2 is Martens hardness measured on the domains that are exposed at the outer surface of the conductive member, and T(A) is not more than 80.0° C. where T(A) is an onset temperature of the storage elastic modulus E of the toner according to powder dynamic viscoelastic measurement.

11. A cartridge set, comprising:

a first cartridge and a second cartridge that are disposed detachably to a main body of an electrophotographic apparatus;

the first cartridge comprising a charging unit configured to charge a surface of an electrophotographic photosensitive member and having a first frame supporting the charging unit, the charging unit comprises a conductive member disposed to be contactable with the electrophotographic photosensitive member; and the second cartridge comprising a toner container that accommodates a toner for forming a toner image on the surface of the electrophotographic photosensitive member by developing an electrostatic latent image formed on the surface of the electrophotographic photosensitive member, wherein the conductive member comprises a support having a conductive outer surface, and a conductive layer disposed on the outer surface of the support, the conductive layer comprises a matrix containing a first rubber, and a plurality of domains dispersed in the matrix, each of the domains contains a second rubber and an electronic conductive agent, at least a portion of the domains being exposed at the outer surface of the conductive member, the outer surface of the conductive member comprising the matrix and the domains exposed therein, the matrix has a volume resistivity R1 of at least $2.00\times10^{12}$ Ω·cm, the domains have a volume resistivity R2 that is smaller than R1, G1<G2, and G1 and G2 are both within 1.0 to 10.0 $N/mm^2$ where G1 is Martens hardness measured on the matrix that is exposed at the outer surface of the conductive member, and G2 is Martens hardness measured on the domains that are exposed at the outer surface of the conductive member, and T(A) is not more than 80.0° C. where T(A) is an onset temperature of the storage elastic modulus E' of the toner according to powder dynamic viscoelastic measurement.

* * * * *